US011196207B2

(12) United States Patent
Tan

(10) Patent No.: US 11,196,207 B2
(45) **Date of Patent: *Dec. 7, 2021**

(54) CARD EDGE CONNECTOR WITH PROTECTIVE COVER

(71) Applicant: Molex, LLC, Lisle, IL (US)

(72) Inventor: Chin Guan Tan, Jurong Town (SG)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/060,094

(22) Filed: Oct. 1, 2020

(65) Prior Publication Data

US 2021/0021075 A1 Jan. 21, 2021

Related U.S. Application Data

(63) Continuation of application No. 16/601,597, filed on Oct. 15, 2019, now Pat. No. 10,797,428.

(30) Foreign Application Priority Data

Oct. 16, 2018 (CN) ..... 201811203224.7

(51) Int. Cl.
*H01R 13/447* (2006.01)
*H01R 13/52* (2006.01)
(Continued)

(52) U.S. Cl.
CPC ..... *H01R 13/447* (2013.01); *H01R 12/52* (2013.01); *H01R 12/57* (2013.01);
(Continued)

(58) Field of Classification Search
CPC ..... H01R 13/447; H01R 12/52; H01R 12/57; H01R 12/7023; H01R 12/725; H01R 12/728; H01R 12/732; H01R 13/5213
See application file for complete search history.

(56) References Cited

U.S. PATENT DOCUMENTS 6,368,129 B1 4/2002 Wang et al.
6,854,991 B2 2/2005 Taga
(Continued)

FOREIGN PATENT DOCUMENTS

CN 2699518 Y 5/2005
CN 104617423 A 5/2015
(Continued)

OTHER PUBLICATIONS

Notice of allowance received for U.S. Appl. No. 16/601,597, dated May 28, 2020, 9 pages.

*Primary Examiner* — Tho D Ta

(57) ABSTRACT

A card edge connector is adapted to allow an electronic module to insert and comprises an elongated insulating housing and a plurality of conductive terminals. The insulating housing has two side walls which are spaced apart from each other, the two side walls together define a card edge insertion groove which has an opening. The card edge connector further comprises a covering member which is correspondingly mounted to the terminal mounting wall, the covering member has a body and a tongue portion which is connected to the body and has flexibility, the body is mounted to the top surface of the terminal mounting wall, the tongue portion at least partially covers the opening of the card edge insertion groove, when the electronic module is inserted into the card edge insertion groove, the tongue portion contacts the electronic module and flexes toward the card edge insertion groove.

20 Claims, 28 Drawing Sheets

(51) Int. Cl.

| | |
|---|---|
| ***H01R 12/52*** | (2011.01) |
| ***H01R 12/73*** | (2011.01) |
| ***H01R 12/70*** | (2011.01) |
| ***H01R 12/72*** | (2011.01) |
| ***H01R 12/57*** | (2011.01) |

(52) U.S. Cl.
CPC ..... *H01R 12/7023* (2013.01); *H01R 12/725* (2013.01); *H01R 12/728* (2013.01); *H01R 12/732* (2013.01); *H01R 13/5213* (2013.01)

(56) References Cited

U.S. PATENT DOCUMENTS

| | | | | |
|---|---|---|---|---|
| 10,797,428 | B2 * | 10/2020 | Tan ..... | H01R 13/447 |
| 2003/0176089 | A1 | 9/2003 | Taga | |
| 2005/0153585 | A1 | 7/2005 | Bu et al. | |
| 2014/0080334 | A1 | 3/2014 | Tetsuya | |
| 2018/0069334 | A1 | 3/2018 | Li et al. | |
| 2019/0058270 | A1 | 2/2019 | Henry et al. | |
| 2019/0372256 | A1 | 12/2019 | Phillips et al. | |

FOREIGN PATENT DOCUMENTS

| | | | |
|---|---|---|---|
| CN | 204858086 | U | 12/2015 |
| CN | 206610932 | U | 11/2017 |
| CN | 207801019 | U | 8/2018 |
| JP | H11-86953 | A | 3/1999 |
| TW | M472341 | U | 2/2014 |
| TW | 201806258 | A | 2/2018 |

* cited by examiner

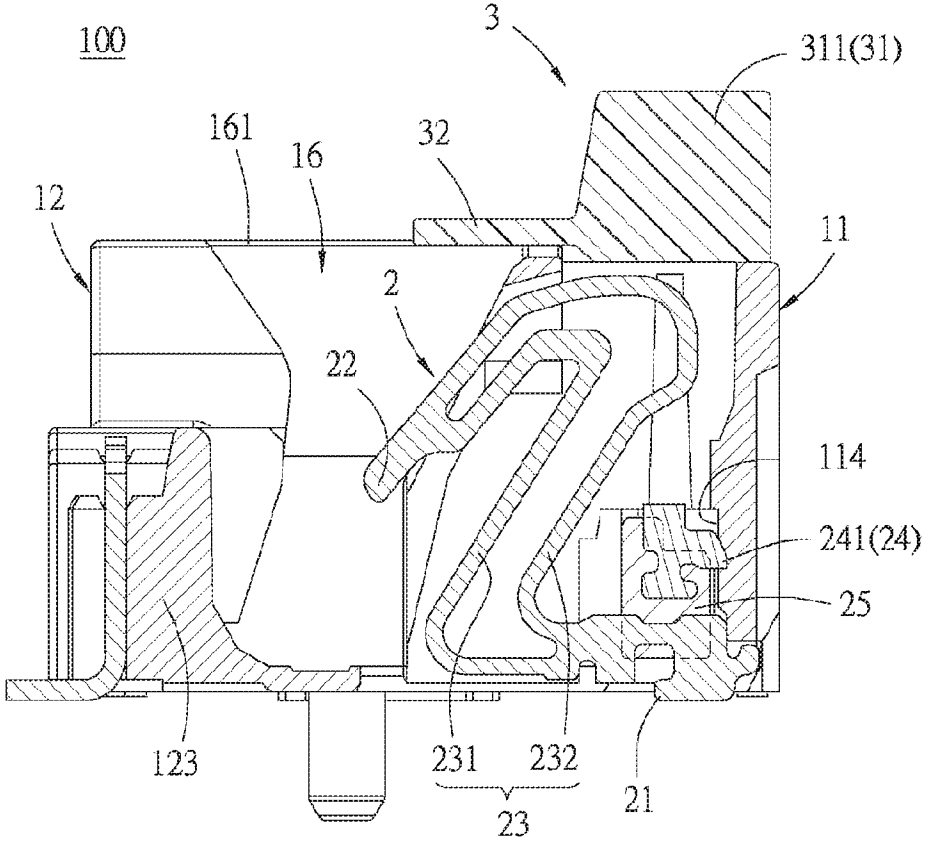
FIG. 9
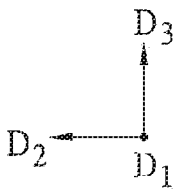

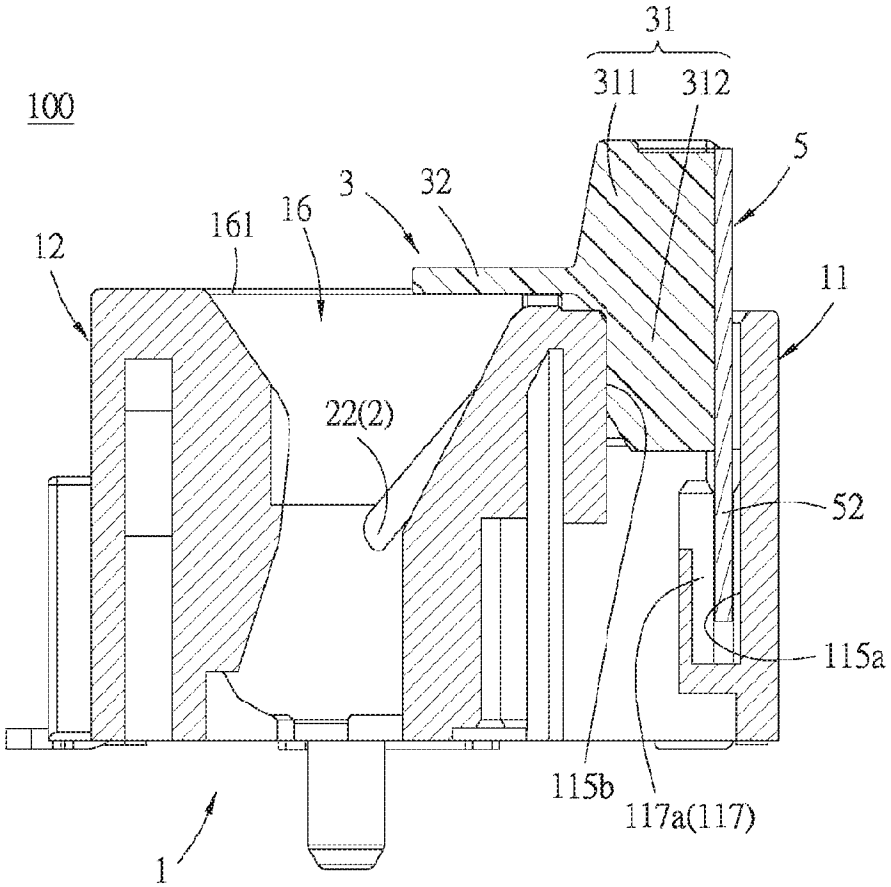
FIG. 27
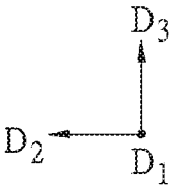

CARD EDGE CONNECTOR WITH PROTECTIVE COVER

RELATED APPLICATIONS

This application is a continuation of U.S. patent application Ser. No. 16/601,597, filed Oct. 15, 2019, which claims priority to Chinese Application No. 201811203224.7, filed Oct. 16, 2018, both of which are incorporated herein by reference in their entirety.

TECHNICAL FIELD

The present disclosure relates to a card edge connector, especially relates to a card edge connector with a covering member.

BACKGROUND

Japanese patent application publication No. JPH1186953A, as a prior art, discloses a dust preventing cover mounted on an insulator of a connector, however, the dust preventing cover generally needs to be removed before a printed circuit board is inserted. Although the printed circuit board inserts into an insertion groove and covers a part of the insertion groove at use state, there still exists a very large gap between the printed circuit board and the insertion groove at this state, particles such as dust and the like would still enter into the insertion groove and adhere on the terminal.

U.S. Pat. No. 6,854,991 (corresponding to U.S. Pat. No. 6,932,630, Chinese patent issuance publication No. CN1275356C and Chinese Patent issuance publication No. CN100524963C), as another prior art, discloses a dust preventing connector, a first dust preventing cover and a second dust preventing cover made of suitable elastic material are respectively provided to a first connector and a second connector. When the first connector and the second connector are connected with each other, the first dust preventing cover and the second dust preventing cover can cooperate with each other to bend outwardly and deform elastically. However, when the first connector and the second connector are mated with each other, a slant section of the first dust preventing cover and a slant section of the second dust preventing cover move outwardly from a space between a connecting face of the first connector and a connecting face of the second connector, at this state, the first dust preventing cover and the second dust preventing cover do not provide the dust preventing function.

SUMMARY

Therefore, an object of the present disclosure is to provide a card edge connector which can improve at least one of the shortcomings of the prior art.

Accordingly, in some embodiments, a card edge connector of the present disclosure comprises an elongated insulating housing and a plurality of conductive terminals. The insulating housing extends in a length direction, has two side walls which extend in the length direction and are spaced apart from each other in a width direction and two end walls which connect the two side walls at two ends in the length direction, the two side walls and the two end walls together define a card edge insertion groove which has an opening, at least one of the two side walls is a terminal mounting wall, the terminal mounting wall has a top surface which faces the same direction as the opening of the card edge insertion groove. The plurality of conductive terminals are arranged as a row in the length direction and provided to the terminal mounting wall, each conductive terminal has a contact portion which extends into the card edge insertion groove. The card edge connector further comprises a covering member which is correspondingly mounted to the terminal mounting wall, the covering member has a body and a tongue portion which is connected to the body and has flexibility, the body is mounted to the top surface of the terminal mounting wall, the tongue portion extends in the length direction and at least partially covers the opening of the card edge insertion groove in the width direction.

In some embodiments, the terminal mounting wall is formed with a plurality of terminal grooves which respectively receive the conductive terminals, each terminal groove has an aperture positioned on the top surface of the terminal mounting wall, the body of the covering member covers the apertures of the plurality of terminal grooves.

In some embodiments, the terminal mounting wall is formed with two mounting grooves at the top surface, each mounting groove has a mounting groove portion, the body of the covering member has an elongated portion which extends in the length direction and provided to the top surface of the terminal mounting wall and two mounting columns which respectively extend from the elongated portion and insert into the mounting groove portions of the mounting grooves.

In some embodiments, an inner wall surface of the mounting groove portion of each mounting groove is formed with an interference protruding block which interferences with the corresponding mounting column.

In some embodiments, the terminal mounting wall is formed with two mounting grooves at the top surface, each mounting groove has an insertion groove portion, the card edge connector further comprises a bracket provided to the covering member, the bracket comprises a bracket body which extends in the length direction and allows the body of the covering member to be provided and two mounting structures which extend respectively from two ends of the bracket body and insert into the insertion groove portions of the mounting grooves.

In some embodiments, each mounting groove further has a mounting groove portion communicated with the insertion groove portion, the body of the covering member has an elongated portion which extends in the length direction and is provided to the top surface of the terminal mounting wall and two mounting columns which extend respectively from the elongated portion and insert into the mounting groove portions of the mounting grooves.

In some embodiments, the bracket body of the bracket is formed with a first fixing structure which is provided to the elongated portion and two second fixing structures which are respectively provided to the mounting columns.

In some embodiments, each mounting structure has an inserting piece and an interference portion which is formed to the inserting piece and interferences with the insertion groove portion.

In some embodiments, the terminal mounting wall further has two first end portions which are positioned at two ends in the length direction and respectively connect the two end walls and a terminal providing portion which is positioned between the two first end portions and is provided with the plurality of conductive terminals, the two mounting grooves are respectively formed at the two first end portions of the terminal mounting wall.

In some embodiments, one of the two side walls is the terminal mounting wall, the other of the two side walls is a limiting wall which is not provided with the conductive terminal, the limiting wall has a recess opening which is formed at the top surface and corresponds to the plurality of conductive terminals in position and a low wall portion which is positioned below the recess opening and lower than the terminal mounting wall in height.

Accordingly, in some embodiments, a card edge connector of the present disclosure is adapted to allow an electronic module to insert, the card edge connector comprises an elongated insulating housing and a plurality of conductive terminals. The insulating housing extends in a length direction, has two side walls which extend in the length direction and are spaced apart from each other in a width direction and two end walls which connect the two side walls at two ends in the length direction, the two side walls and the two end walls together define a card edge insertion groove which has an opening, at least one of the two side walls is a terminal mounting wall, the terminal mounting wall has a top surface which faces the same direction as the opening of the card edge insertion groove. The plurality of conductive terminals are arranged as a row in the length direction and provided to the terminal mounting wall, each conductive terminal has a contact portion which extends into the card edge insertion groove. The card edge connector further comprises a covering member which is correspondingly mounted to the terminal mounting wall, the covering member has a body and a tongue portion which is connected to the body and has flexibility, the body is mounted to the top surface of the terminal mounting wall, the tongue portion extends in the length direction and at least partially covers the opening of the card edge insertion groove in the width direction, when the electronic module is inserted into the card edge insertion groove, the tongue portion contacts the electronic module and flexes toward the card edge insertion groove, and covers a gap between the electronic module and the terminal mounting wall.

In some embodiments, the terminal mounting wall is formed with a plurality of terminal grooves which respectively receive the conductive terminals, each terminal groove has an aperture positioned on the top surface of the terminal mounting wall, the body of the covering member covers the apertures of the plurality of terminal grooves.

In some embodiments, the terminal mounting wall is formed with two mounting grooves at the top surface, each mounting groove has a mounting groove portion, the body of the covering member has an elongated portion which extends in the length direction and provided to the top surface of the terminal mounting wall and two mounting columns which respectively extend from the elongated portion and insert into the mounting groove portions of the mounting grooves.

In some embodiments, an inner wall surface of the mounting groove portion of each mounting groove is formed with an interference protruding block which interferences with the corresponding mounting column.

In some embodiments, the terminal mounting wall is formed with two mounting grooves at the top surface, each mounting groove has an insertion groove portion, the card edge connector further comprises a bracket provided to the covering member, the bracket comprises a bracket body which extends in the length direction and allows the body of the covering member to be provided and two mounting structures which extend respectively from two ends of the bracket body and insert into the insertion groove portions of the mounting grooves.

In some embodiments, each mounting groove further has a mounting groove portion communicated with the insertion groove portion, the body of the covering member has an elongated portion which extends in the length direction and is provided to the top surface of the terminal mounting wall and two mounting columns which extend respectively from the elongated portion and insert into the mounting groove portions of the mounting grooves.

In some embodiments, the bracket body of the bracket is formed with a first fixing structure which is provided to the elongated portion and two second fixing structures which are respectively provided to the mounting columns.

In some embodiments, each mounting structure has an inserting piece and an interference portion which is formed to the inserting piece and interferences with the insertion groove portion.

In some embodiments, the terminal mounting wall further has two first end portions which are positioned at two ends in the length direction and respectively connect the two end walls and a terminal providing portion which is positioned between the two first end portions and is provided with the plurality of conductive terminals, the two mounting grooves are respectively formed at the two first end portions of the terminal mounting wall.

In some embodiments, one of the two side walls is the terminal mounting wall, the other of the two side walls is a limiting wall which is not provided with the conductive terminal, the limiting wall has a recess opening which is formed at the top surface and corresponds to the plurality of conductive terminals in position and a low wall portion which is positioned below the recess opening and lower than the terminal mounting wall in height.

The present disclosure has at least following technical effects: by that the tongue portion of the covering member covers the opening of the card edge insertion groove and the contact portions of the plurality of conductive terminals positioned below, and by that the body of the covering member covers the aperture of each terminal groove positioned at the top surface, it prevents particles such as metal or dust and the like falling into the card edge insertion groove or the terminal grooves to contaminate the conductive terminals, in turn avoids phenomena such as poor contact or short circuit occurring, and promotes the electric contact performance of the plurality of conductive terminals. And even if after the electronic module is inserted into the card edge insertion groove, the tongue portion of the covering member having flexibility still can cooperate with the electronic module to flex to cover a gap between the electronic module and the terminal mounting wall of the insulating housing.

BRIEF DESCRIPTION OF THE DRAWINGS

Other features and effects of the present disclosure will be apparent from the embodiments with reference to figures, in which:

FIG. 9 is a cross-sectional view taken along a line A-A of FIG. 8.

FIG. 27 is a cross-sectional view taken along a line E-E of FIG. 26.

FIG. 28 is a cross-sectional view taken along a line F-F of FIG. 26.

DETAILED DESCRIPTION OF THE PREFERRED EMBODIMENTS

Figure 1:
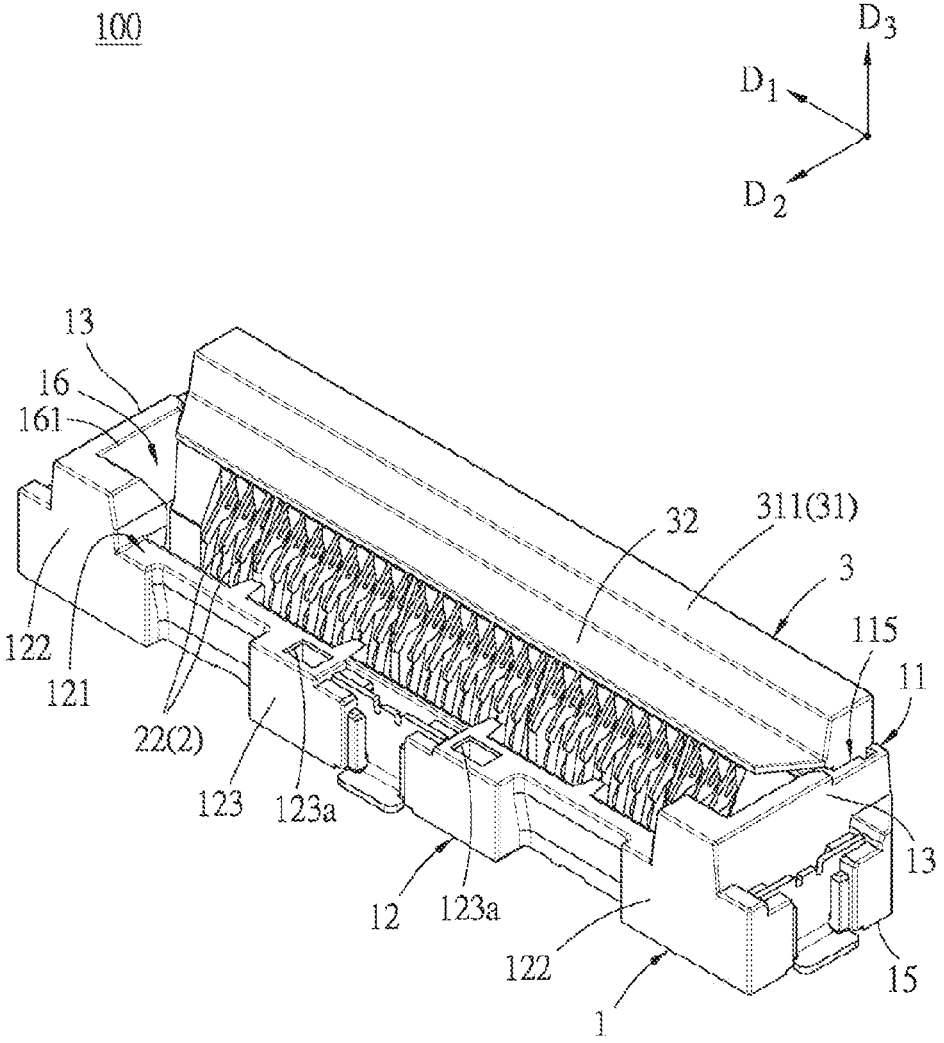
FIG. 1 is a perspective view of a first embodiment of a card edge connector of the present disclosure.
Figure 2:
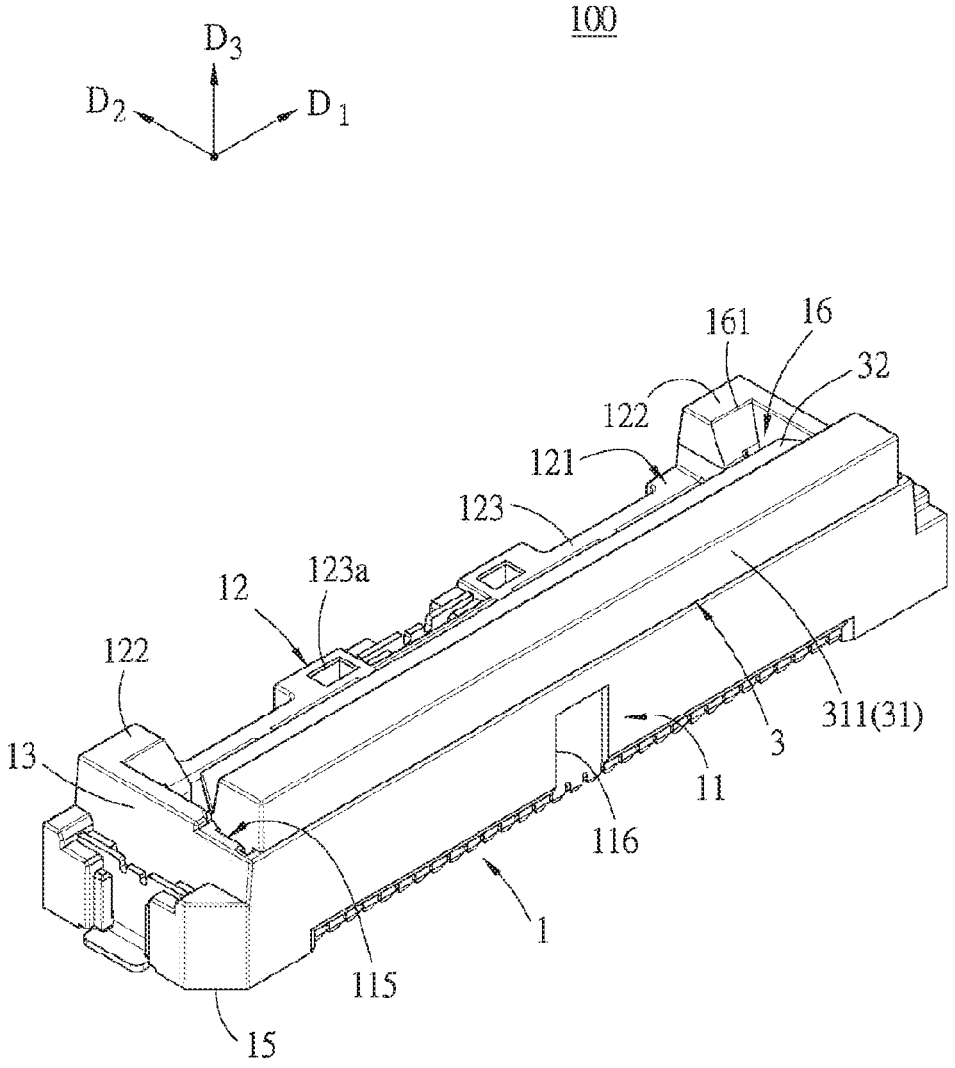
FIG. 2 is a perspective view of FIG. 1 from another angle.
Figure 3:
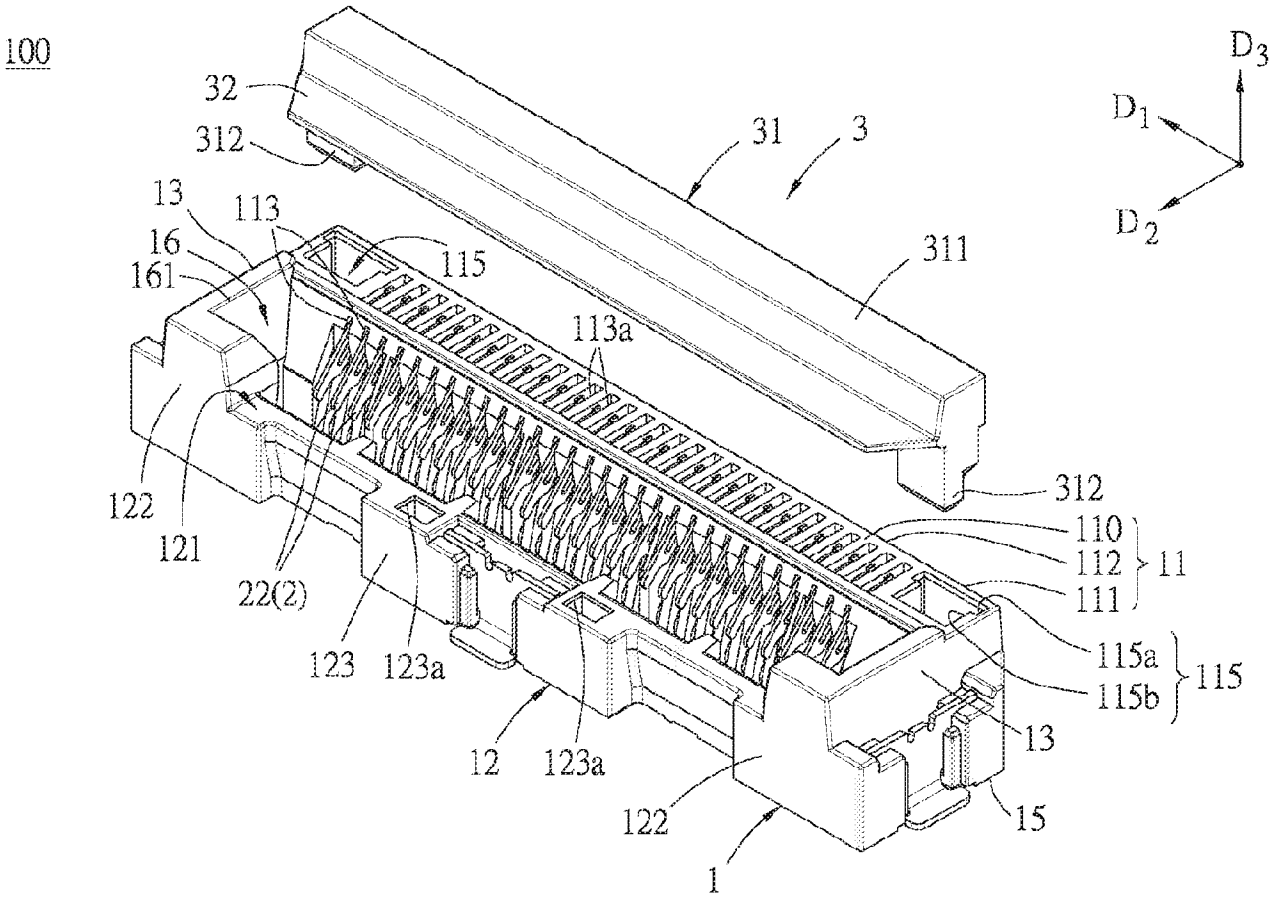
FIG. 3 is a perspective exploded view of FIG. 1.
Figure 4:
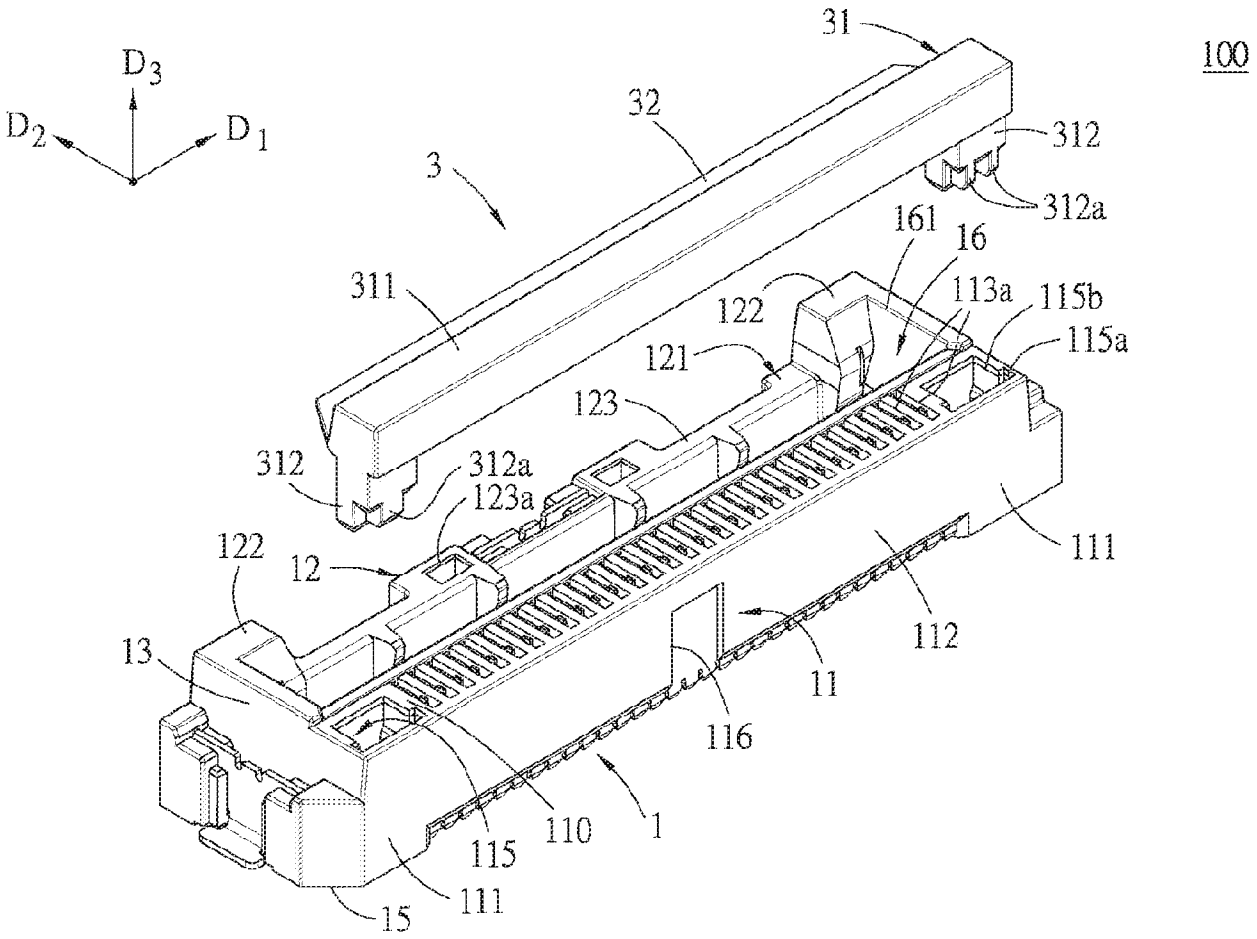
FIG. 4 is a perspective exploded view of FIG. 2.
Figure 5:
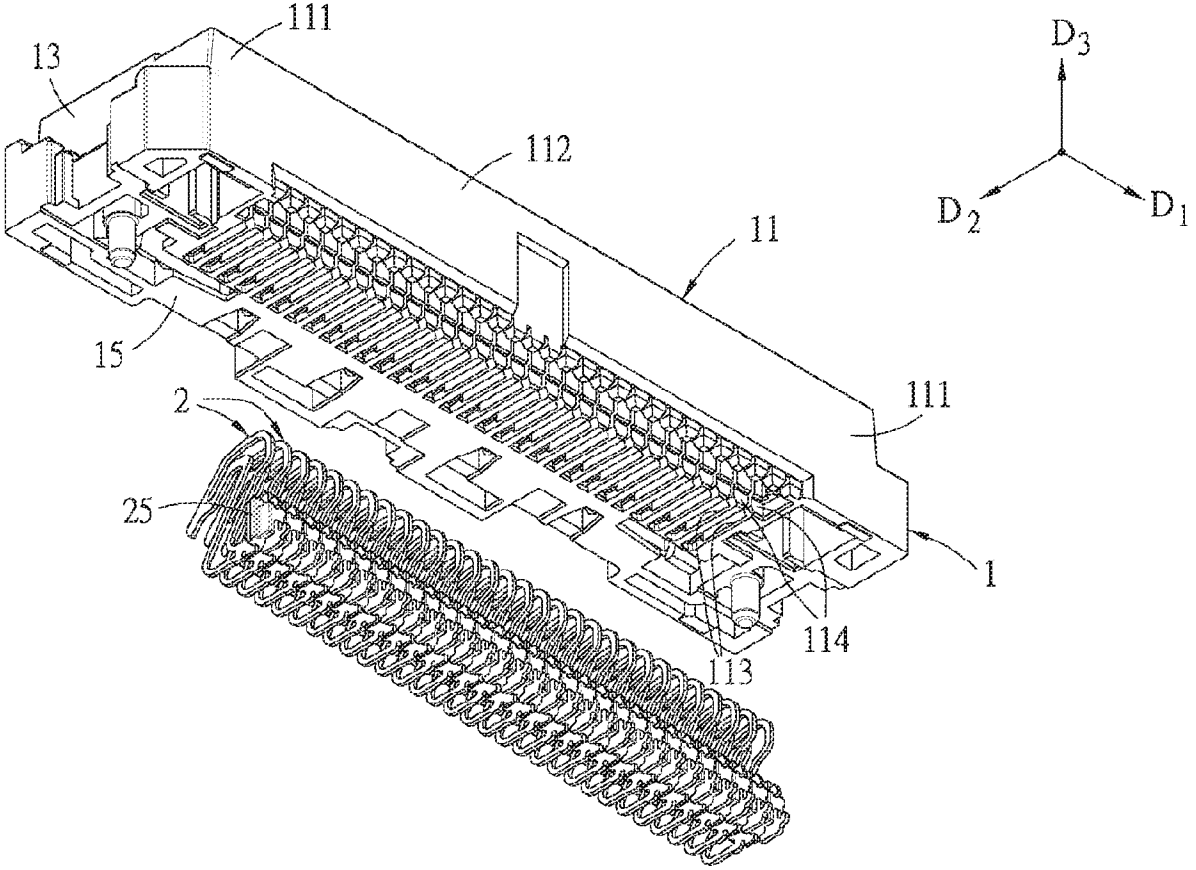
FIG. 5 is a perspective exploded view illustrating an insulating housing and conductive terminals of the first embodiment.
Figure 6:
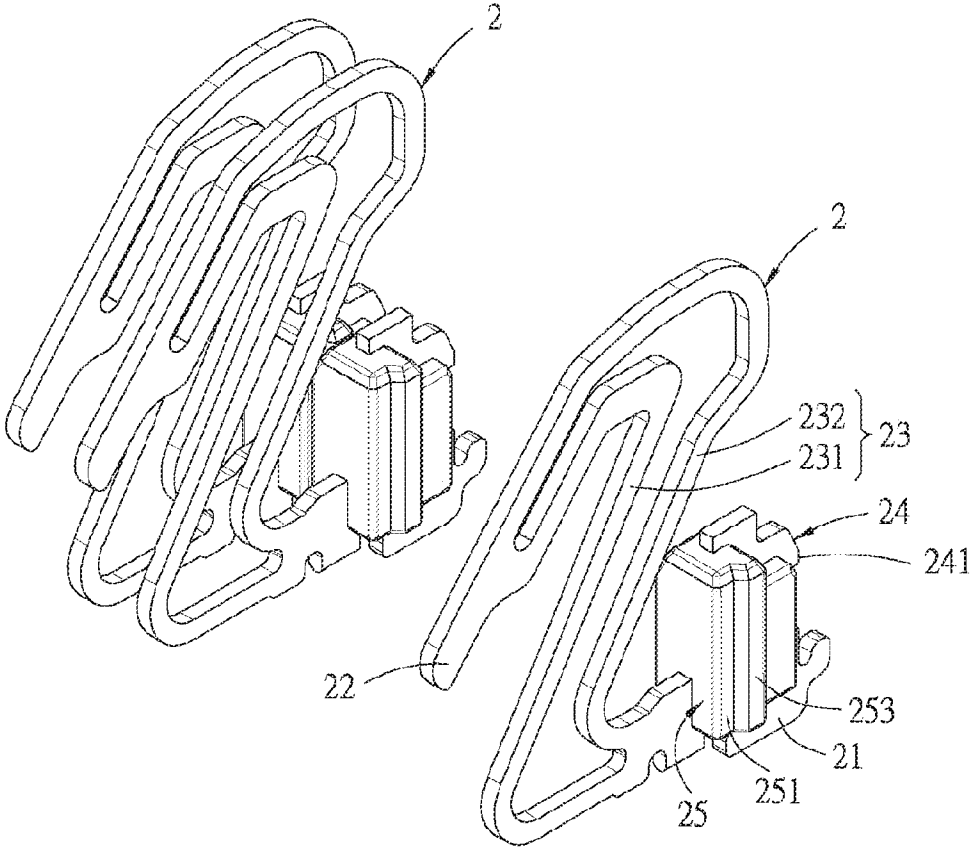
FIG. 6 is a perspective exploded view illustrating the conductive terminals of the first embodiment.
Figure 7:
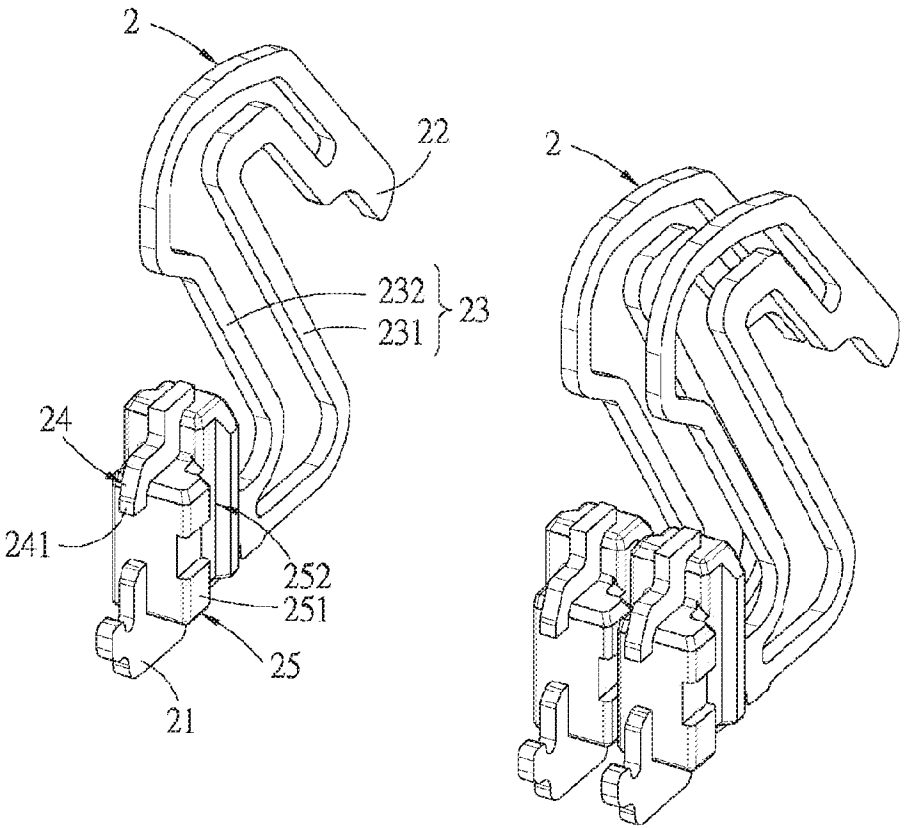
FIG. 7 is a perspective view of FIG. 6 from another angle.
Figure 8:
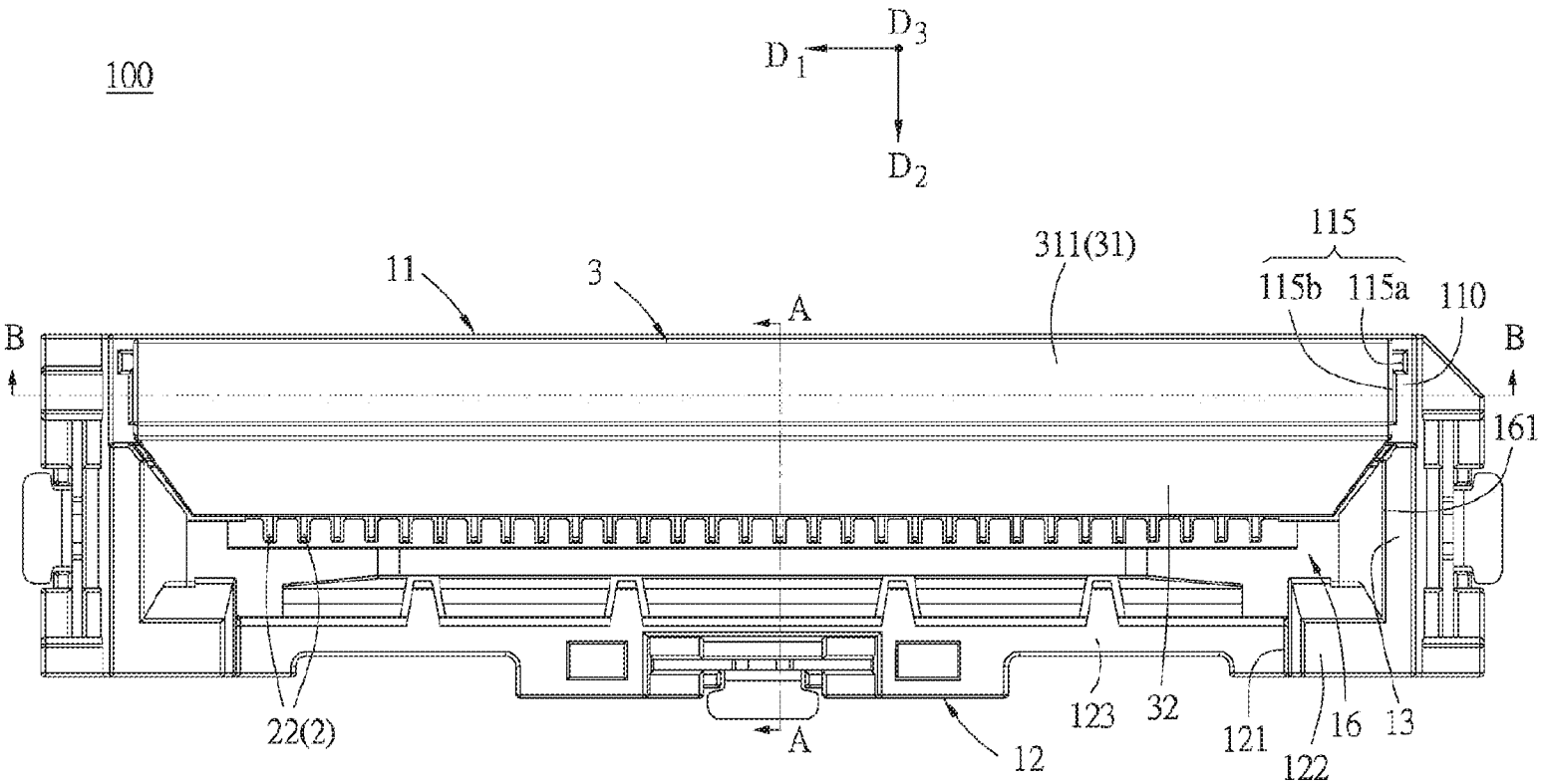
FIG. 8 is a top view of the first embodiment.
Figure 10:
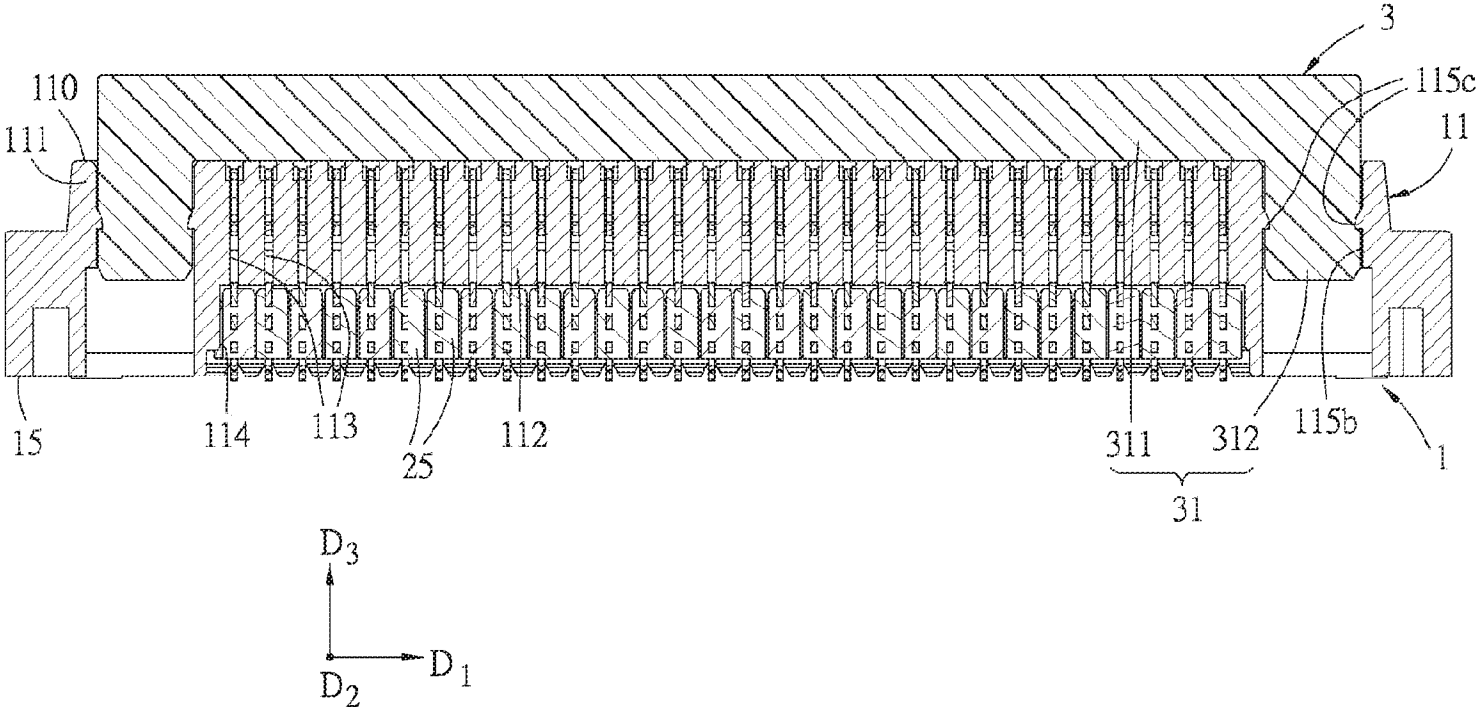
FIG. 10 is a cross-sectional view taken along a line B-B of FIG. 8.

Before the present disclosure is described in detail, it should be noted that similar element is represented by the same reference numeral in the following description.

Figure 15:
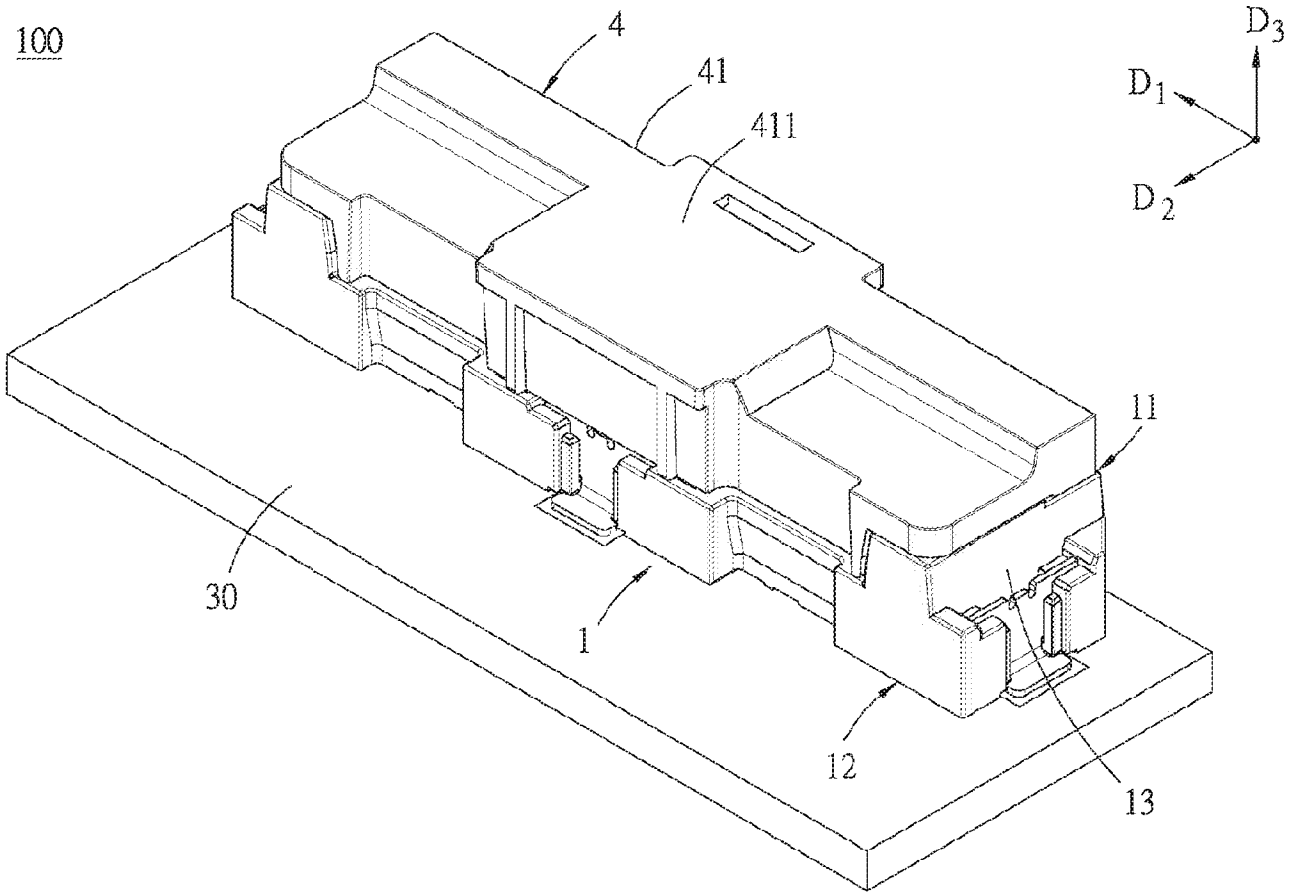
FIG. 15 is a perspective view illustrating a protective cap of the first embodiment.
Figure 16:
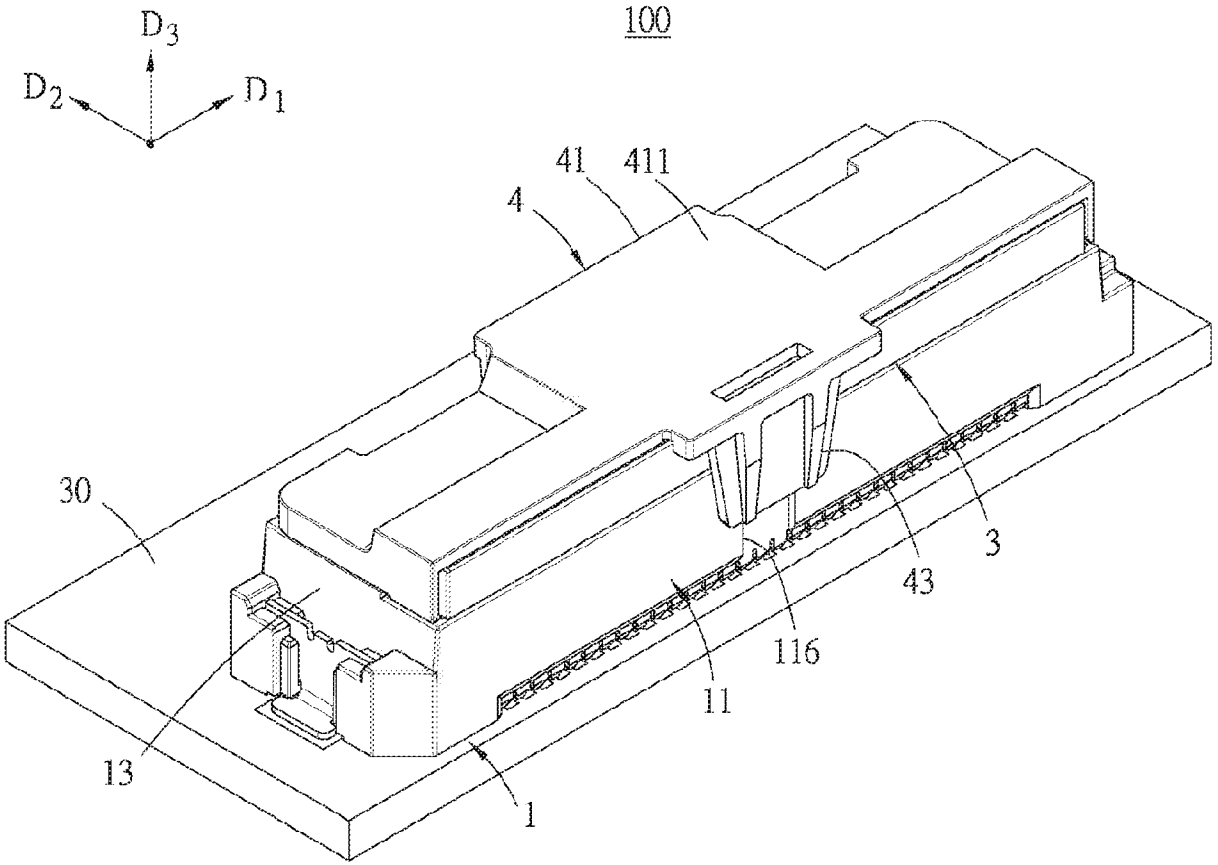
FIG. 16 is a perspective view of FIG. 15 from another angle.
Figure 17:
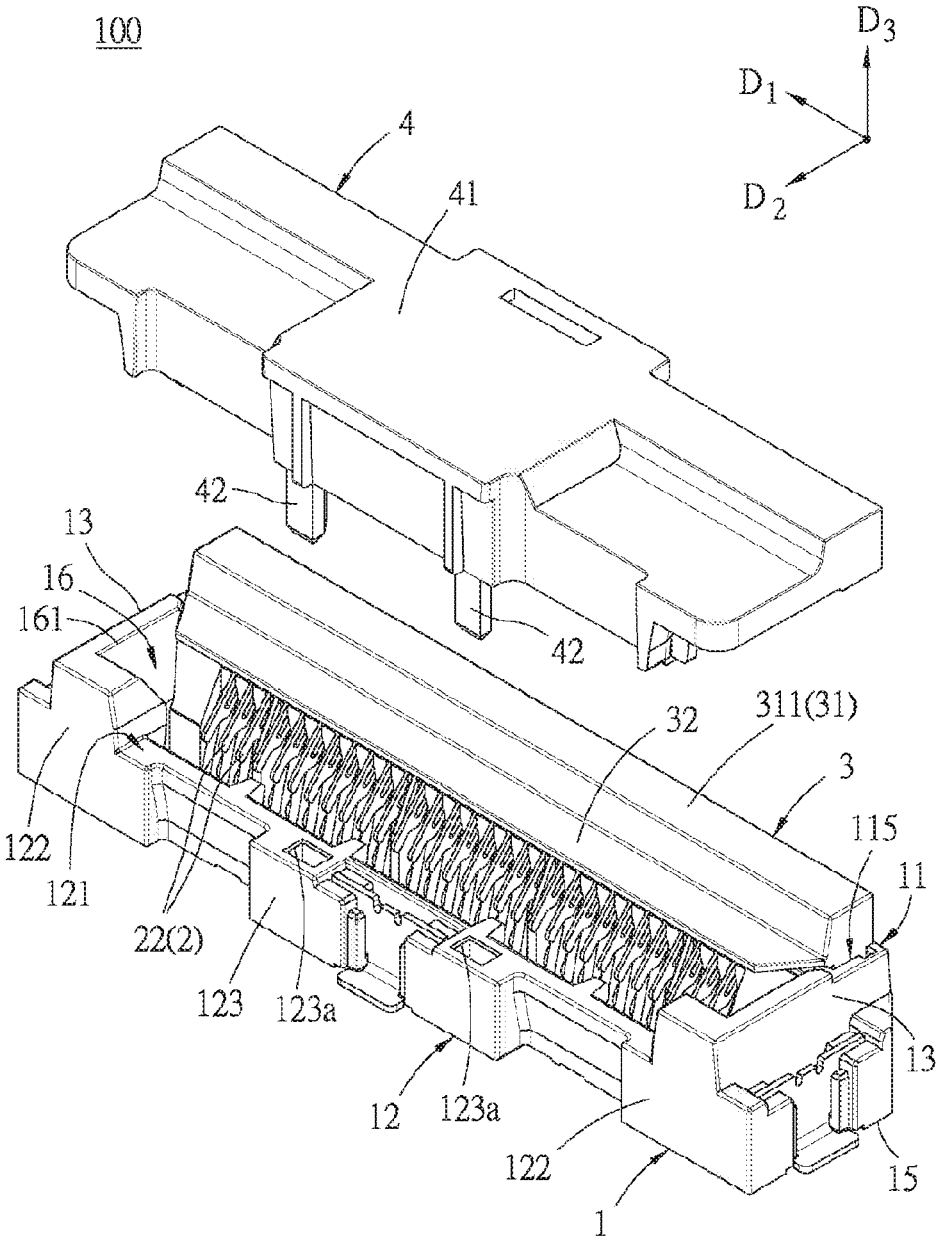
FIG. 17 is a perspective exploded view of FIG. 15.
Figure 18:
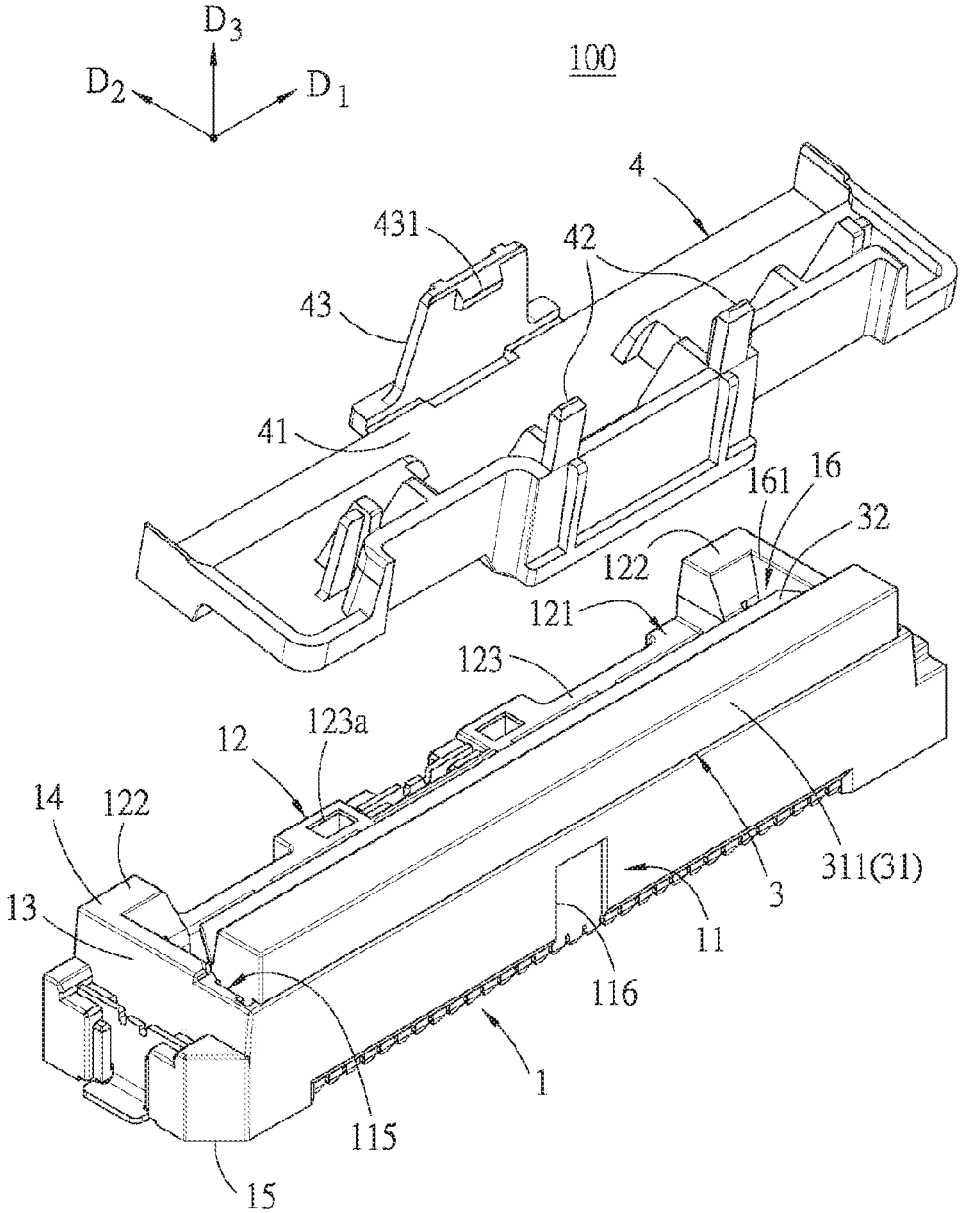
FIG. 18 is a perspective view of FIG. 17 from another angle with the protective cap rotated by a certain angle.

Referring to FIG. 1 to FIG. 4, a first embodiment of a card edge connector 100 of the present disclosure is adapted to mount on a circuit board 30 (see FIG. 15 and FIG. 16), and comprises an elongated insulating housing 1, a plurality of conductive terminals 2 and a covering member 3.

The insulating housing 1 extends in a length direction D1, and has two side walls which extend in the length direction D1 and are spaced apart from each other in a width direction D2, one of the two side walls is a terminal mounting wall 11, the other of the two side walls is a limiting wall 12. The insulating housing 1 further has two end walls 13 which respectively connect the two side walls at two ends in the length direction D1. The terminal mounting wall 11, the limiting wall 12 and the two end walls 13 together form a bottom mounting surface 15 which is used to mount on the circuit board 30, and together define a card edge insertion groove 16 which extends in a height direction D3 and has an opening 161 facing upwardly. The terminal mounting wall 11 has a top surface 110 which faces the same direction as the opening 161 of the card edge insertion groove 16, two first end portions 111 which are positioned at two ends in the length direction D1 and respectively connect the two end walls 13, and a terminal providing portion 112 which is positioned between the two first end portions 111 and is provided with the plurality of conductive terminals 2. The limiting wall 12 has a recess opening 121 which is formed at a top surface of the limiting wall 12 and corresponds to the terminal providing portion 112 provided with the plurality of conductive terminals 2 in position, two second end portions 122 which respectively connect the two end walls 13 and are adjacent to two opposite ends of the recess opening 121, and a low wall portion 123 which is positioned between the two second end portions 122 and positioned below the recess opening 121 so as to make a height in the height direction D3 lower than the two second end portions 122. In the first embodiment, the height of the low wall portion 123 is about two thirds or so of the height of the terminal mounting wall 11, which may be changed according to the actual need.

Referring to FIG. 3 and FIG. 5 to FIG. 7, the plurality of conductive terminals 2 are arranged as a row along the length direction D1 and provided to the terminal mounting wall 11, each conductive terminal 2 has a base portion 21 which is exposed to the bottom mounting surface 15, a contact portion 22 which extends into the card edge insertion groove 16, an elastic arm portion 23 which connects the base portion 21 and the contact portion 22, a retention portion 24, and a supporting block 25 which connects the base portion 21 and the retention portion 24. The conductive terminal 2 is formed by stamping a metal plate and has a planar plate shape with a consistent thickness. The supporting block 25 is made of an insulating material and directly connects the base portion 21 and the retention portion 24 together after the supporting block 25 is formed by insert molding. The elastic arm portion 23 is composed by an inner elastic arm 231 and an outer elastic arm 232 which together form a closed loop. The inner elastic arm 231 and the outer elastic arm 232 have different contours and inconsistent intervals between the different segments so as to control flex behavior of the conductive terminal 2, can prevent excessive flex of the conductive terminal 2, avoid permanent deformation of the conductive terminal 2, and has effects of anti-vibration and anti-impaction, which makes the contact portions 22 of the plurality of conductive terminals 2 capable of generating excellent function of stable contact during mating.

The supporting block 25 has a main body portion 251, a recessed portion 252 and a protruding portion 253, the recessed portion 252 and the protruding portion 253 are positioned at two opposite sides so that the recessed portion 252 and the protruding portion 253 of two adjacent conductive terminals 2 form complementary structures and makes adjacent supporting blocks 25 abut together when the conductive terminals 2 are arranged side by side. The terminal providing portion 112 of the insulating housing 1 is formed with a plurality of terminal grooves 113 which are formed from the bottom mounting surface 15 and respectively receive the conductive terminals 2, and the terminal providing portion 112 of the insulating housing 1 is formed with receiving grooves 114 which each correspond to each terminal groove 113 and receive a supporting block 25, each terminal groove 113 has an aperture 113*a* positioned on the top surface 110 of the terminal mounting wall 11, adjacent receiving grooves 114 are communicated with each other. When the conductive terminal 2 is assembled to the insulating housing 1, the conductive terminal 2 is placed into the terminal groove 113 from the bottom mounting surface 15, the retention portion 24 of the conductive terminal 2 has an interference protruding block 241 to form interference with a wall surface of the receiving groove 114 so as to fix the conductive terminal 2.

Figure 11:
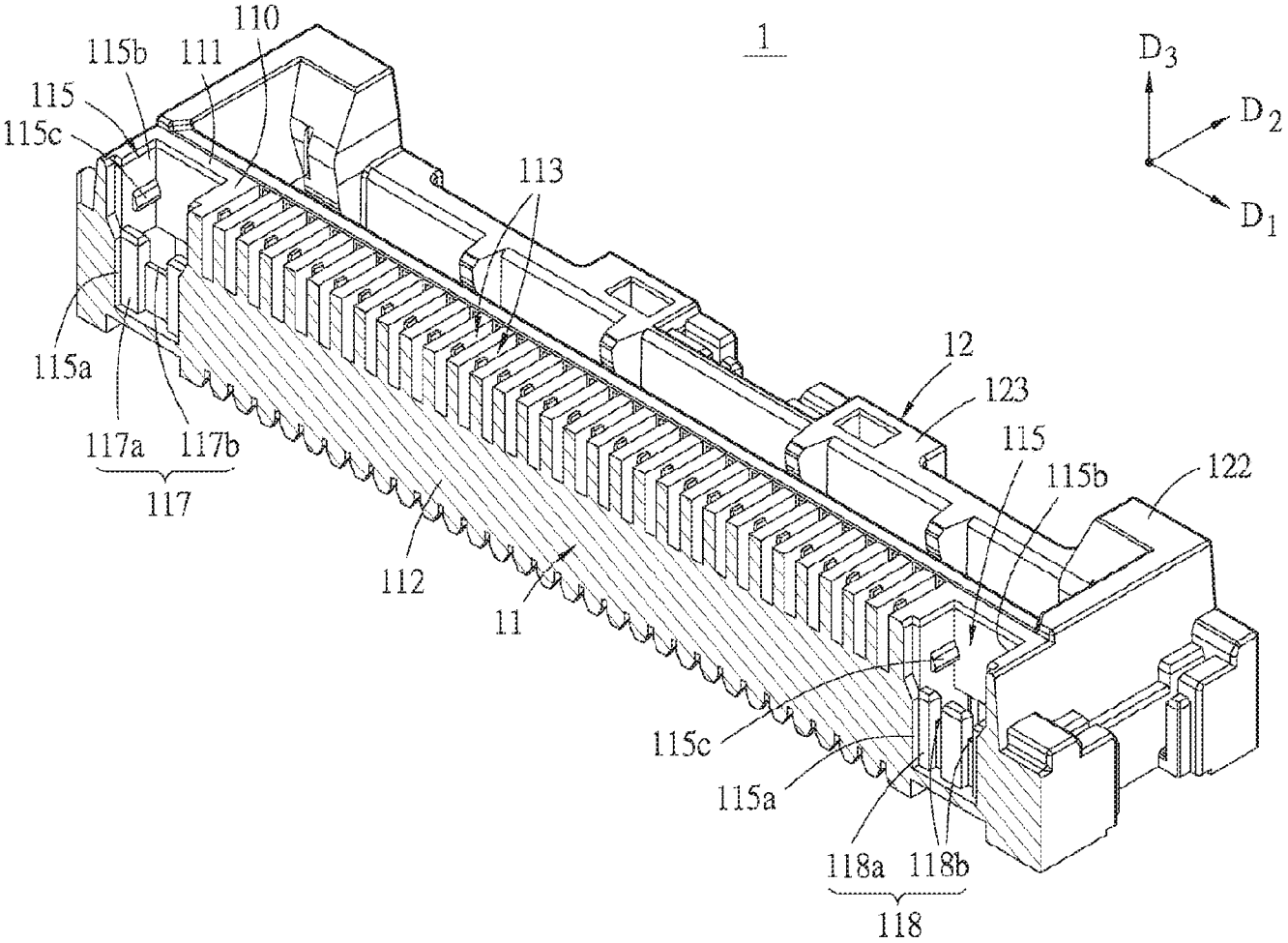
FIG. 11 is a perspective cross-sectional view illustrating mounting grooves of the insulating housing of the first embodiment.

Referring to FIG. 1 to FIG. 4 and FIG. 8 to FIG. 11, the covering member 3 is correspondingly mounted to the terminal mounting wall 11 of the insulating housing 1, the covering member 3 may be made of suitable rubber material (such as silicon rubber), elastic resin material or other material having elasticity. The covering member 3 has a body 31 and a tongue portion 32 which is connected to the body 31 and has flexibility, the body 31 is mounted to the top surface 110 of the terminal mounting wall 11, the tongue portion 32 extends in the length direction D1 and partially covers the opening 161 of the card edge insertion groove 16 in the width direction D2, and a length of the tongue portion 32 in the length direction D1 is gradually shorten toward a tip thereof. The terminal mounting wall 11 has two mounting grooves 115 formed at the top surface 110, the two mounting grooves 115 are respectively formed at the two first end portions 111 of the terminal mounting wall 11. As shown in FIG. 11, each mounting groove 115 has an insertion groove portion 115*a* away from the card edge insertion groove 16 and a mounting groove portion 115*b* close to the card edge insertion groove 16 and communicated with the insertion groove portion 115*a*, an inner wall surface of the mounting groove portion 115*b* of each mounting groove 115 is formed with two interference protruding blocks 115*c* which face each other in the length direction D1. And the insertion groove portion 115*a* of each mounting groove 115 is substantially divided into an upper half part and a lower half part and has a shape which is wide at the upper and narrow at the lower, the lower half part of the insertion groove portion 115*a* is the same as the mounting groove portion 115*b* in width, and the upper half part of the insertion groove portion 115*a* is larger than the mounting groove portion 115*b* in width. Each mounting groove 115 is further formed with a partition wall 117, 118 positioned between the lower half part of the insertion groove portion 115*a* and a lower half part of the mounting groove portion 115*b*. The partition wall 117 has a wall body 117*a* and a notch 117*b* formed to a center of a top of the wall body 117*a*, the partition wall 118 has a wall body 118*a* and two notches 118*b* formed to a top of the wall body 118*a* and arranged with each other along the length direction D1. The body 31 of the covering member 3 has an elongated portion 311 which extends in the length direction D1 and is provided at the top surface 110 of the terminal mounting wall 11 and two mounting columns 312 which respectively extend downwardly from two ends of the elongated portion 311 and insert into the mounting groove portions 115*b* of the mounting grooves 115, the elongated portion 311 of the body 31 covers the apertures 113*a* of the plurality of the terminal grooves 113 positioned at the top surface 110. When the two mounting columns 312 are inserted into the mounting groove portions 115*b* of the two mounting grooves 115, the interference protruding blocks 115*c* interference with the mounting columns 312 having elasticity, so as to make that the two mounting columns 312 respectively generate holding force of interference fit with the mounting groove portions 115*b* of the two mounting grooves 115. And, the mounting column 312 which is correspondingly inserted into the mounting groove 115 formed with the partition wall 117 is formed with one protruding portion 312*a* correspondingly snapping into the notch 117*b*, the mounting column 312 which is correspondingly inserted into the mounting groove 115 formed with the partition wall 118 is formed with two protruding portions 312*a* respectively correspondingly snapping into the notches 118*b*, thereby preventing the mounting columns 312 being not correspondingly inserted into the mounting grooves 115, so as to avoid the covering member 3 being mounted to the insulating housing 1 in a wrong direction. By that the tongue portion 32 of the covering member 3 covers the opening 161 of the card edge insertion groove 16 and the contact portions 22 of the plurality of conductive terminals 2 positioned below, and by that the body 31 of the covering member 3 covers the aperture 113*a* of each terminal groove 113, it prevents particles such as metal, dust and the like falling into the card edge insertion groove 16 or the plurality of terminal grooves 113 to contaminate the conductive terminals 2, in turn avoids phenomena such as poor contact or short circuit occurring, and promotes electric contact performance of the plurality of conductive terminals 2. In the first embodiment, the covering member 3 correspondingly mounted to the terminal mounting wall 11 is one in number, it may deduce that, in a varied embodiment, the two side walls may be terminal mounting walls 11, the covering member 3 may also be two in number and respectively correspondingly mounted to the two terminal mounting walls 11.

Figure 12:
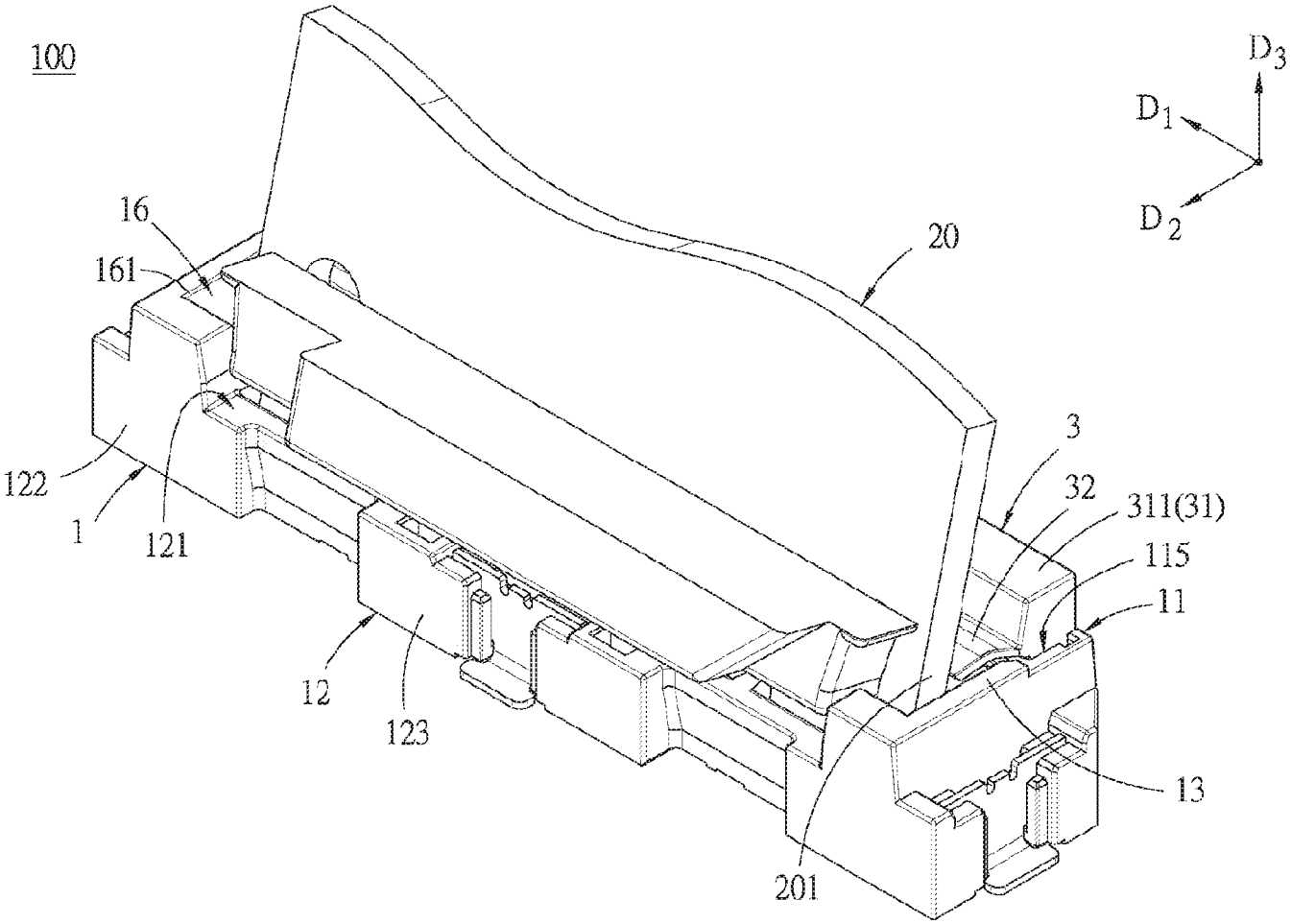
FIG. 12 is a perspective view illustrating that the first embodiment is mated with an electronic module.
Figure 13:
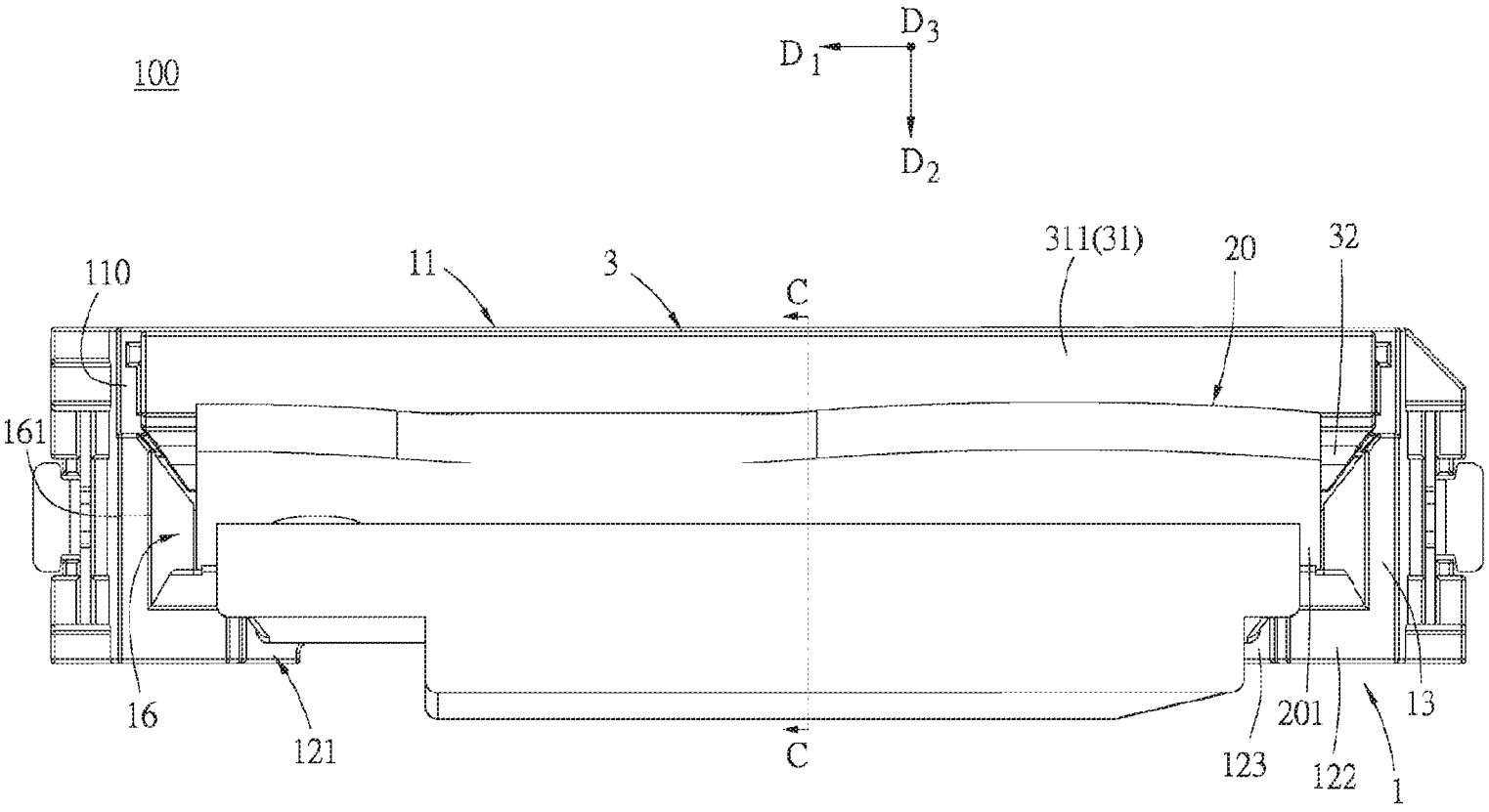
FIG. 13 is a top view of FIG. 12.
Figure 14:
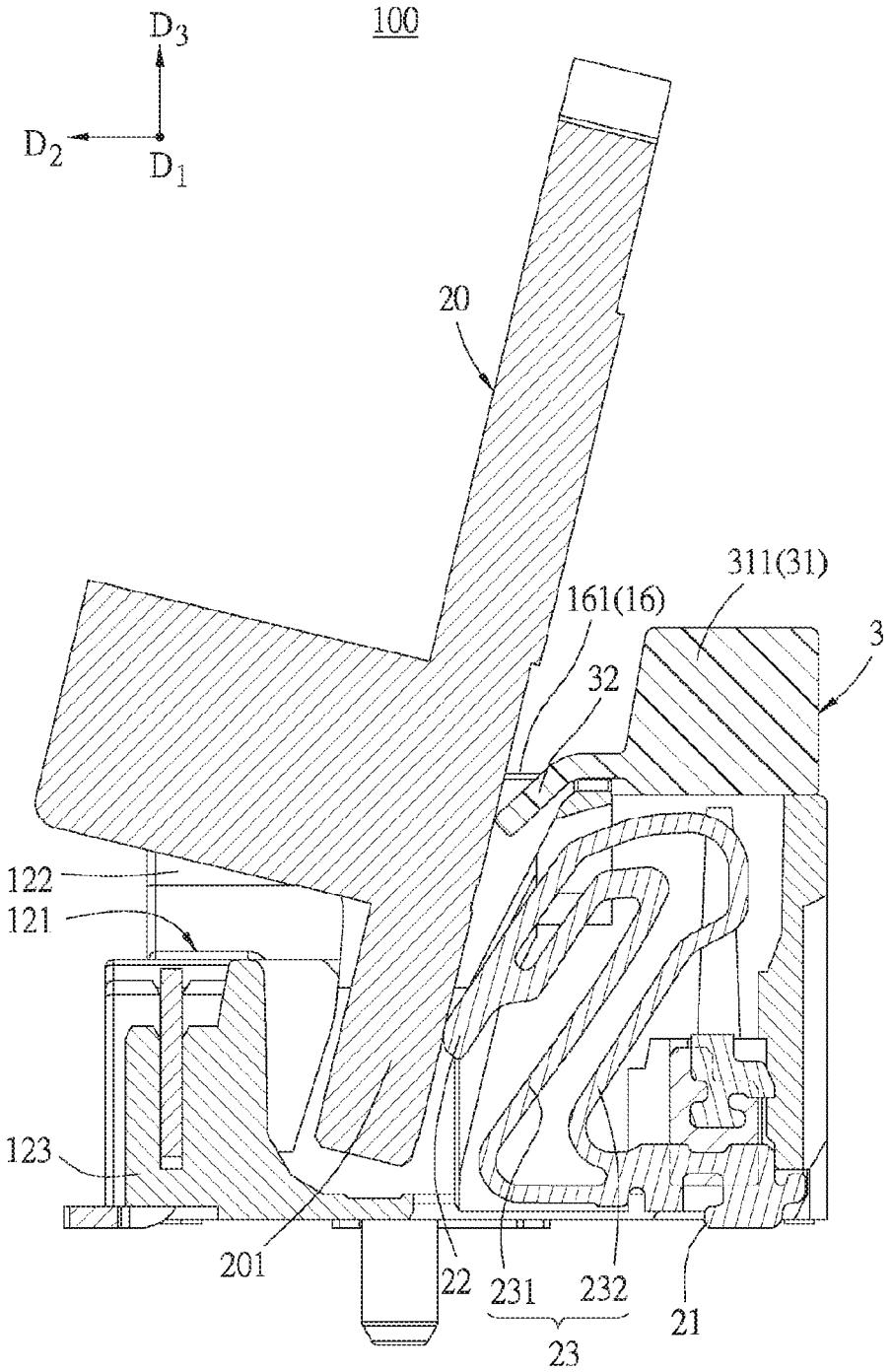
FIG. 14 is a cross-sectional view taken along a line C-C of FIG. 13.

Referring to FIG. 12 to FIG. 14, the card edge connector 100 is adapted to allow a board edge 201 of an electronic module 20 to insert, the recess opening 121 of the limiting wall 12 may form an avoiding space to allow the electronic module 20 to pass through, thereby lowering an insertion position of the electronic module 20. The board edge 201 for example may be a board edge of a circuit board or a tongue of a connector. When the board edge 201 of the electronic module 20 is inserted into the card edge insertion groove 16, the tongue portion 32 having flexibility contacts the electronic module 20 and flexes toward the card edge insertion groove 16. By that the tongue portion 32 having flexibility flexes to cooperate with the electronic module 20, the tongue portion 32 still can cover a gap between the electronic module 20 and the terminal mounting wall 11 after the electronic module 20 is inserted into the card edge insertion groove 16, the covering member 3 can further prevent particles such as metal, dust and the like adhering the plurality of conductive terminals 2 after the card edge connector 100 and the electronic module 20 are mated with each other.

Referring to FIG. 15 to FIG. 18, in the first embodiment, the card edge connector 100 further comprises a protective cap 4 for capping on the insulating housing 1 and the covering member 3. The low wall portion 123 of the limiting wall 12 of the insulating housing 1 is formed with two positioning holes 123*a* at the top thereof, an outer side surface of the terminal mounting wall 11 is formed with a latch recessed groove 116, the protective cap 4 has a cap body 41 which correspondingly caps on a top surface of the insulating housing 1 and a top surface of the covering member 3 to close the card edge insertion groove 16, two positioning protruding columns 42 which extend downwardly from the cap body 41 along the height direction D3 at positions corresponding to the limiting wall 12, and a latch piece 43 which extends downwardly from the cap body 41 along the height direction D3 at a position corresponding to the outer side surface of the terminal mounting wall 11, the latch piece 43 has a latch protrusion 431 formed toward the terminal mounting wall 11. The positioning protruding columns 42 respectively correspondingly insert into the positioning holes 123*a*, the latch protrusion 431 of the latch piece 43 correspondingly latches into the latch recessed groove 116 at the outer side surface of the terminal mounting wall 11, so that the protective cap 4 detachably caps onto the insulating housing 1 and the covering member 3. In this way, the card edge insertion groove 16 of the insulating housing 1 can be capped and protected by the protective cap 4 when the card edge insertion groove 16 of the insulating housing 1 is not mated with the electronic module 20 (see FIG. 12). Moreover, a top surface of the cap body 41 may constitute a surface 411 to allow a pick and place apparatus to pick, which is used to manufacturing of an automatic assembling line.

Figure 19:
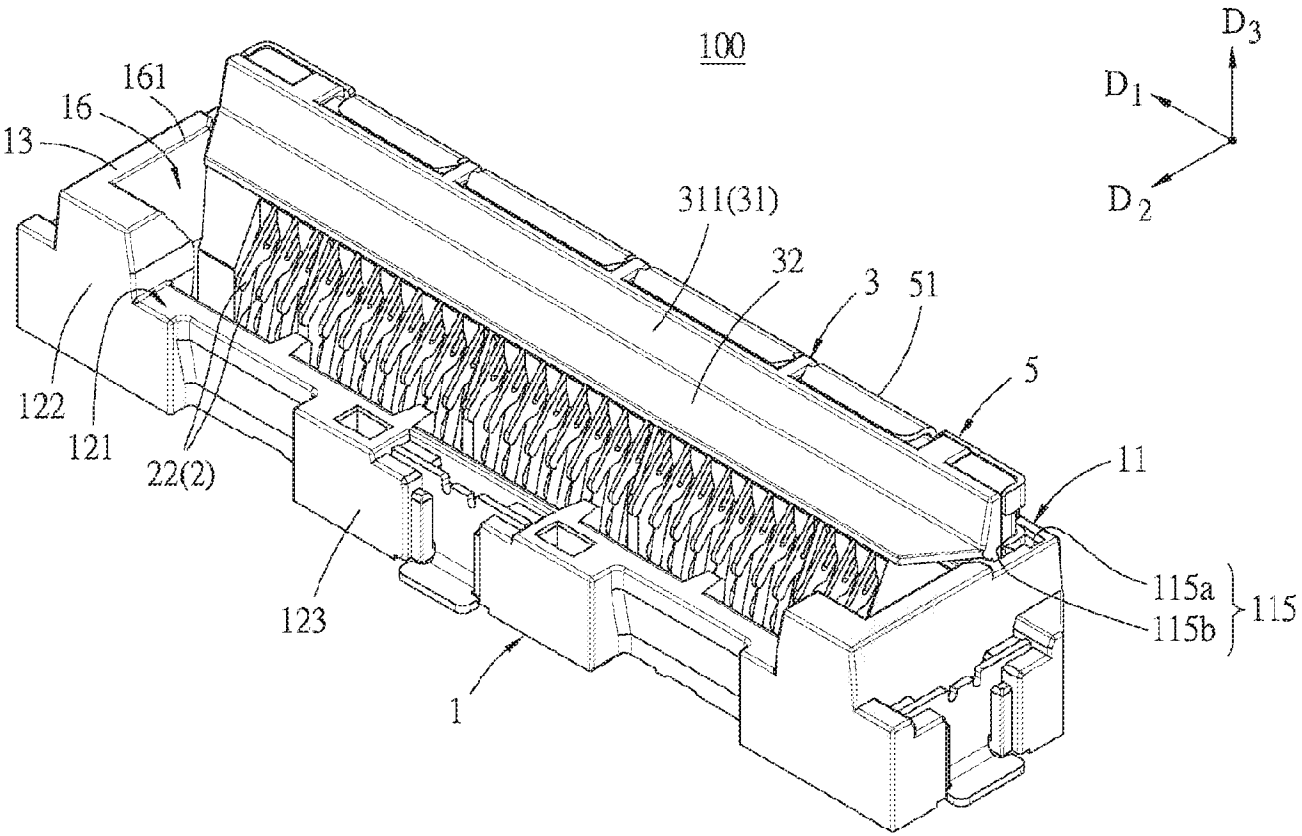
FIG. 19 is a perspective view of a second embodiment of the card edge connector of the present disclosure.
Figure 20:
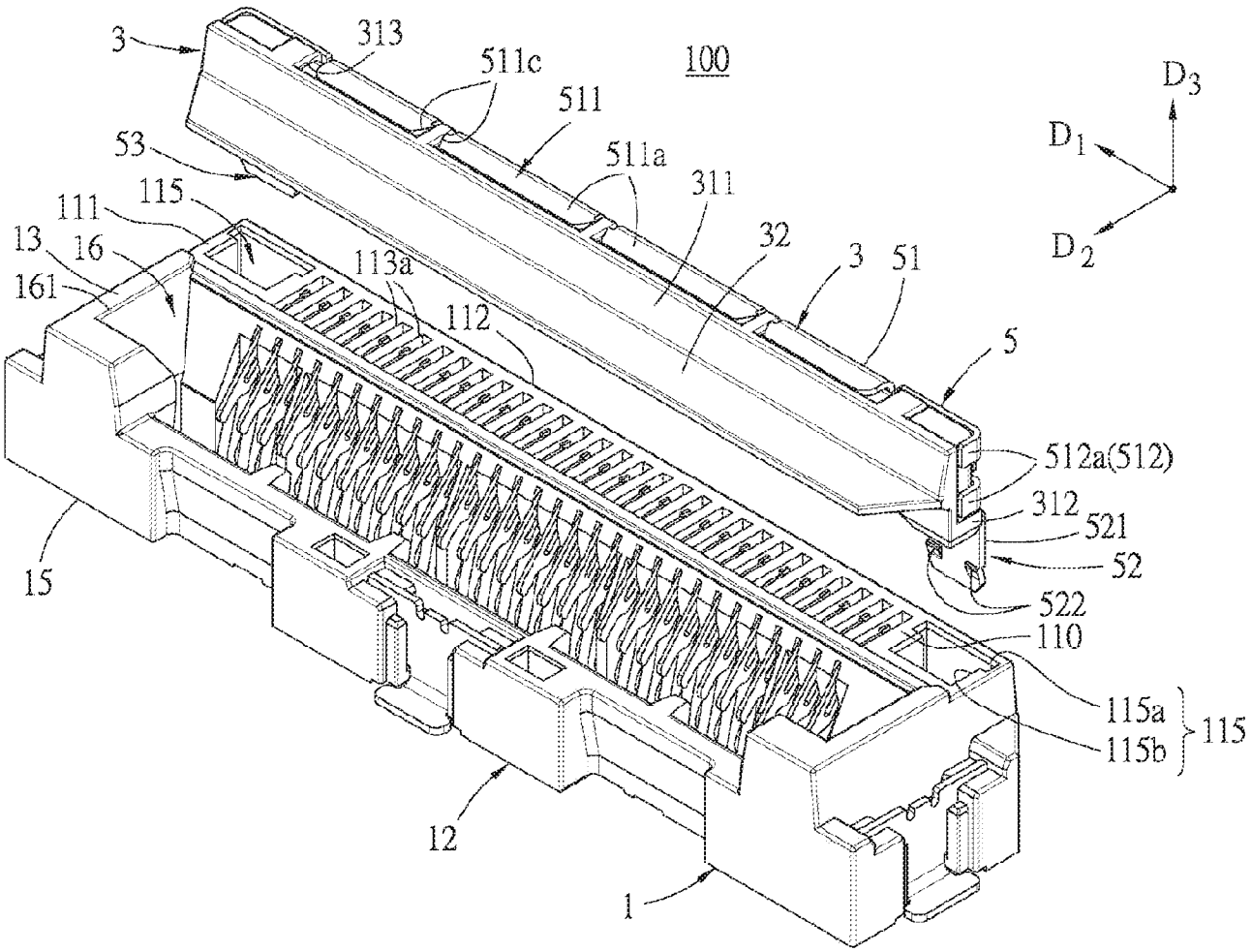
FIG. 20 is a perspective exploded view of FIG. 19.
Figure 21:
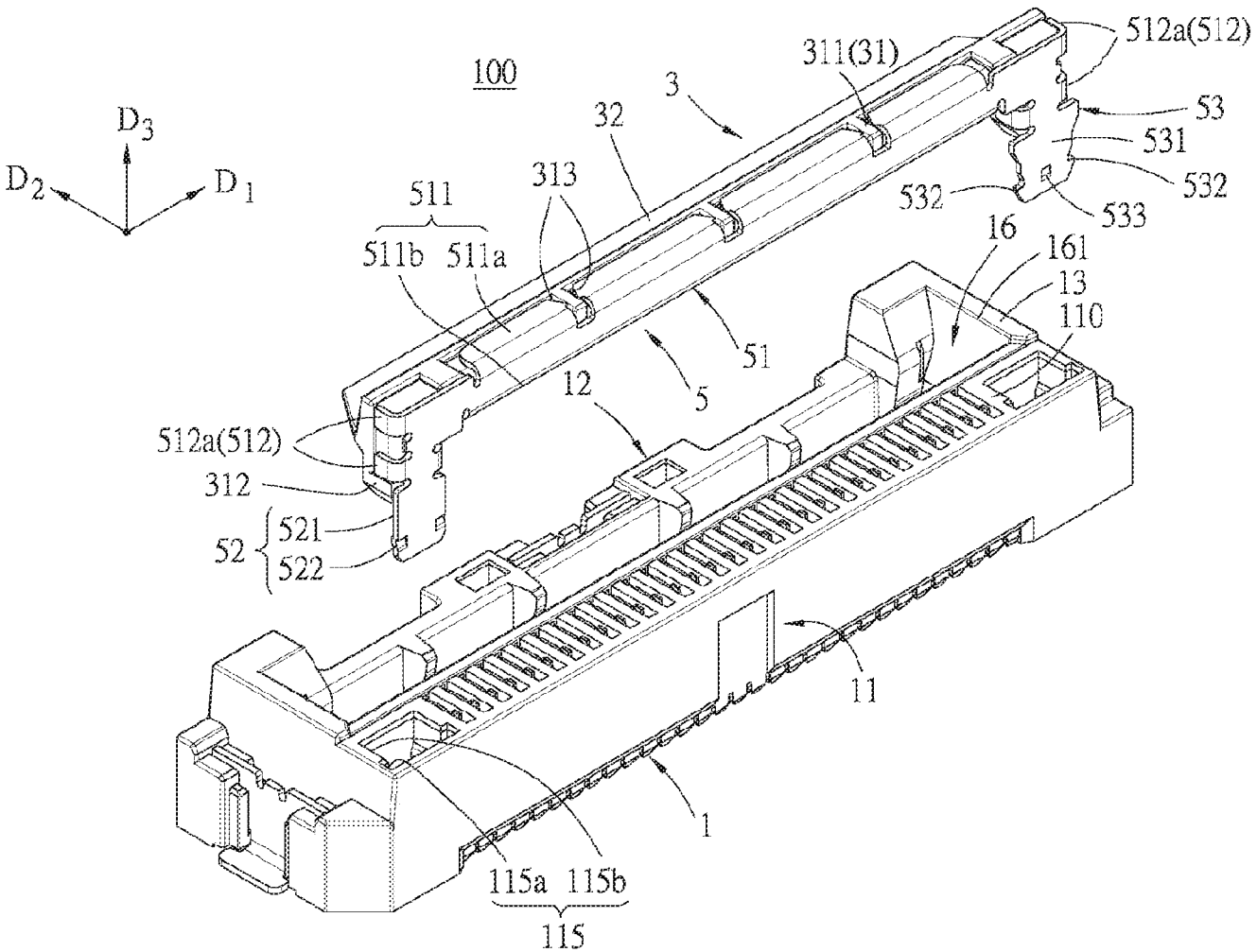
FIG. 21 is a perspective view of FIG. 20 from another angle.

Referring to FIG. 19 to FIG. 21, a second embodiment of the card edge connector 100 of the present disclosure differs from the first embodiment in that, the card edge connector 100 further comprises a bracket 5 provided to the covering member 3, the bracket 5 may be made of stainless steel or other metal material. The bracket 5 comprises a bracket body 51 which extends in the length direction D1 and allows the body 31 of the covering member 3 to be provided and two mounting structures 52, 53 which extend respectively from two ends of the bracket body 51 and insert into the mounting grooves 115.

Referring to FIG. 22 to FIG. 25, the bracket body 51 of the bracket 5 is provided to a side of the body 31 of the covering member 3 opposite to the tongue portion 32, and the bracket body 51 is formed with a first fixing structure 511 which extends toward the tongue portion 32 and clamps the elongated portion 311 and two second fixing structures 512 which extend toward the tongue portion 32 and respectively clamp locations of the mounting columns 312 connected to the elongated portion 311. The first fixing structure 511 has a plurality of upper tabs 511*a* which are arranged as a row in the length direction D1 and press against a top of the elongated portion 311 and a lower tab 511*b* which extends in the length direction D1 and presses against a bottom of the elongated portion 311 so as to clamp the elongated portion 311 with the plurality of upper tabs 511*a*. Each second fixing structure 512 has a plurality of protruding portions 512*a* which together clamp the corresponding mounting column 312. The body 31 of the covering member 3 is formed with a plurality of recessed portions 313 which correspondingly cooperate with the upper tabs 511*a*, the lower tab 511*b* and the protruding portions 512*a*. Moreover, each upper tab 511*a* further has interference protrusions 511*c* formed to two side edges in the length direction D1, the interference protrusions 511*c* are used to interference with the recessed portions 313 of the covering member 3, so as to enhance holding force of the bracket body 51 of the bracket 5 to the body 31 of the covering member 3.

Referring to FIG. 11 and FIG. 20 and FIG. 26 to FIG. 28, the two mounting structures 52, 53 extend downwardly respectively from locations of the bracket body 51 correspondingly below the second fixing structures 512 along corresponding mounting columns 312, and each mounting structure 52, 53 and the corresponding mounting column 312 together insert into the corresponding mounting groove 115, each mounting structure 52, 53 inserts into the insertion groove portion 115*a* of the corresponding mounting groove 115, each mounting column 312 inserts into the mounting groove portion 115*b* of the corresponding mounting groove 115.

Figure 22:
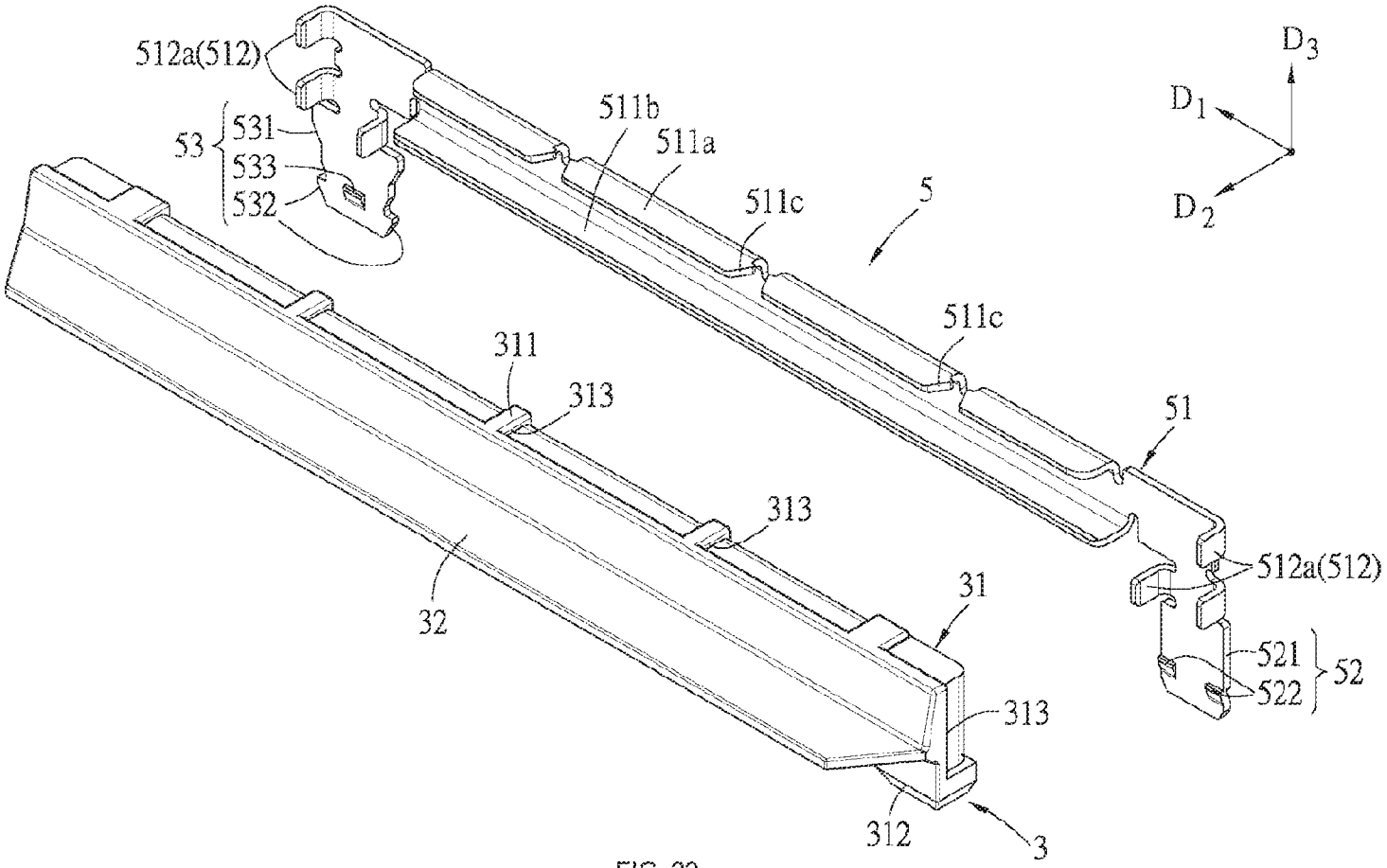
FIG. 22 is a perspective exploded view illustrating the covering member and a bracket of the second embodiment.
Figure 23:
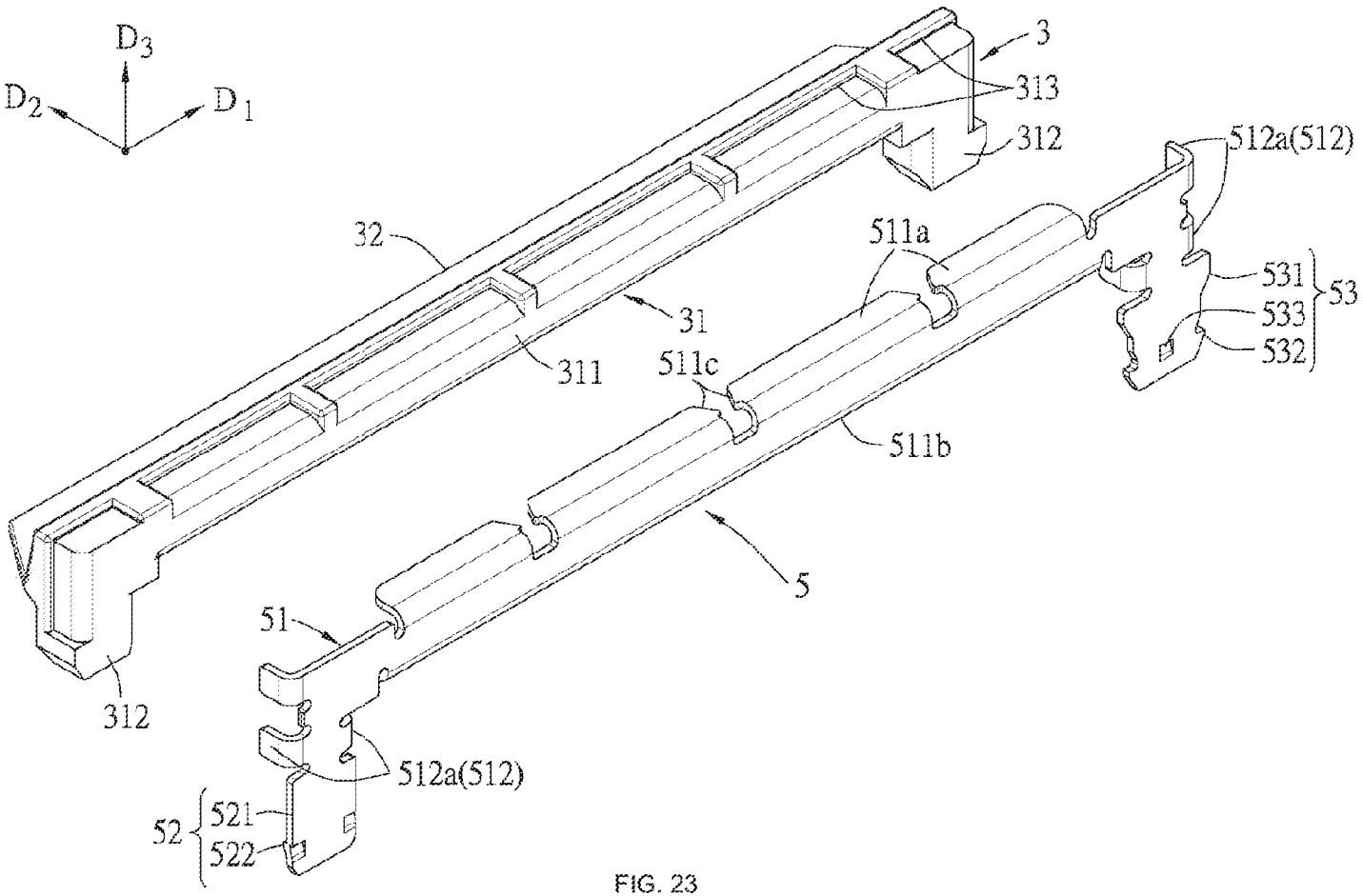
FIG. 23 is a perspective view of FIG. 22 from another angle.
Figure 24:
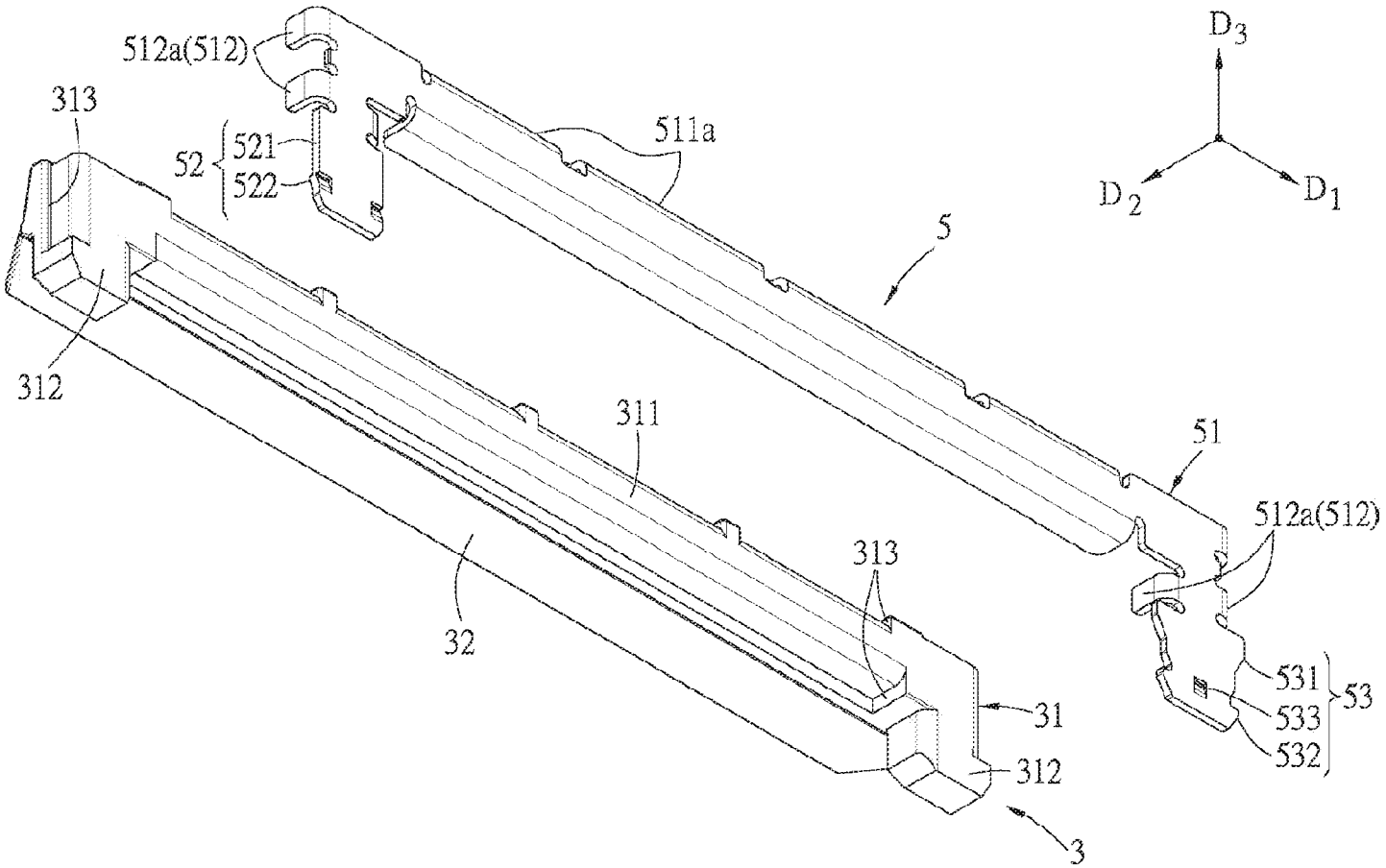
FIG. 24 is a perspective view of FIG. 22 from still another angle.
Figure 25:
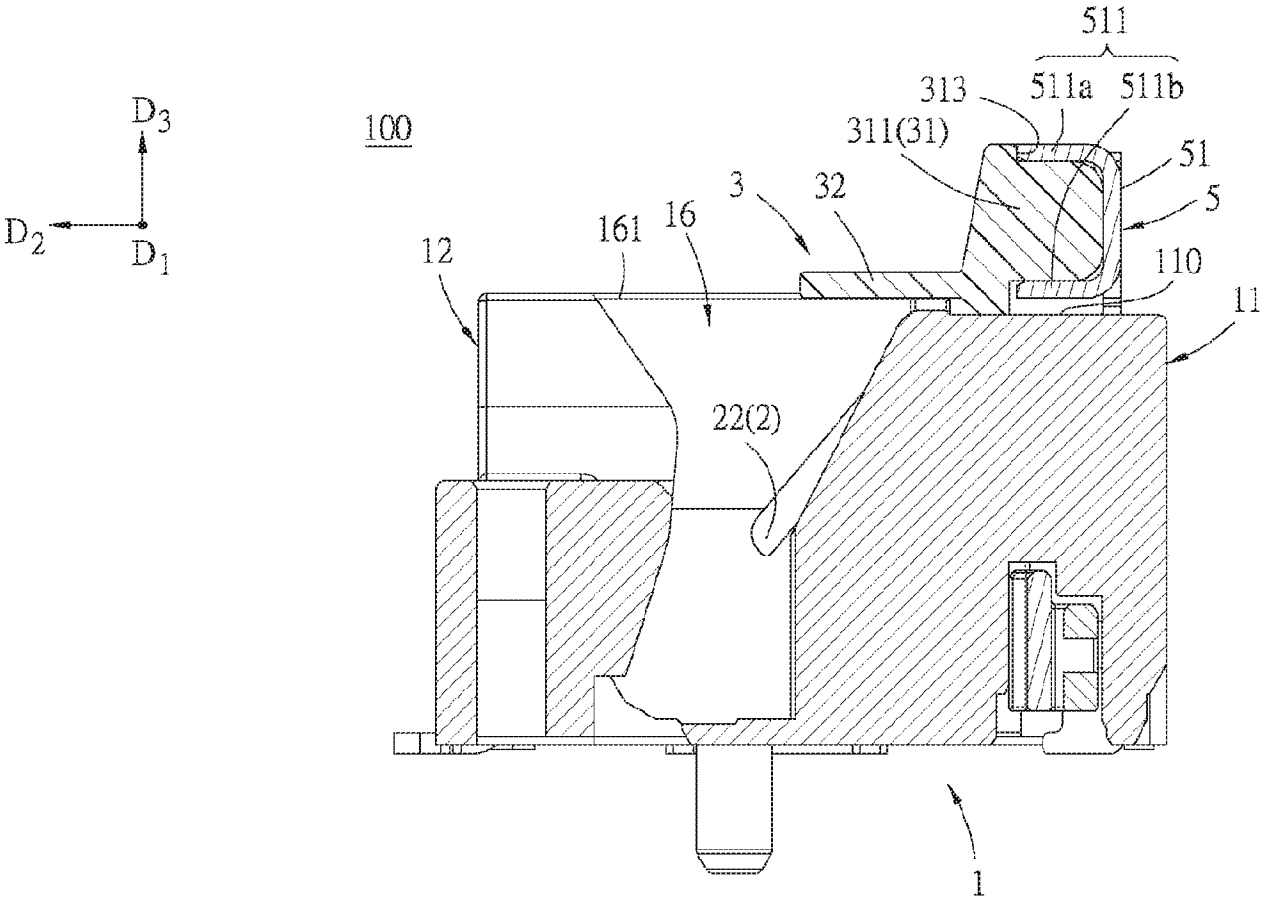
FIG. 25 is a cross-sectional view taken along a line D-D of FIG. 26.
Figure 26:
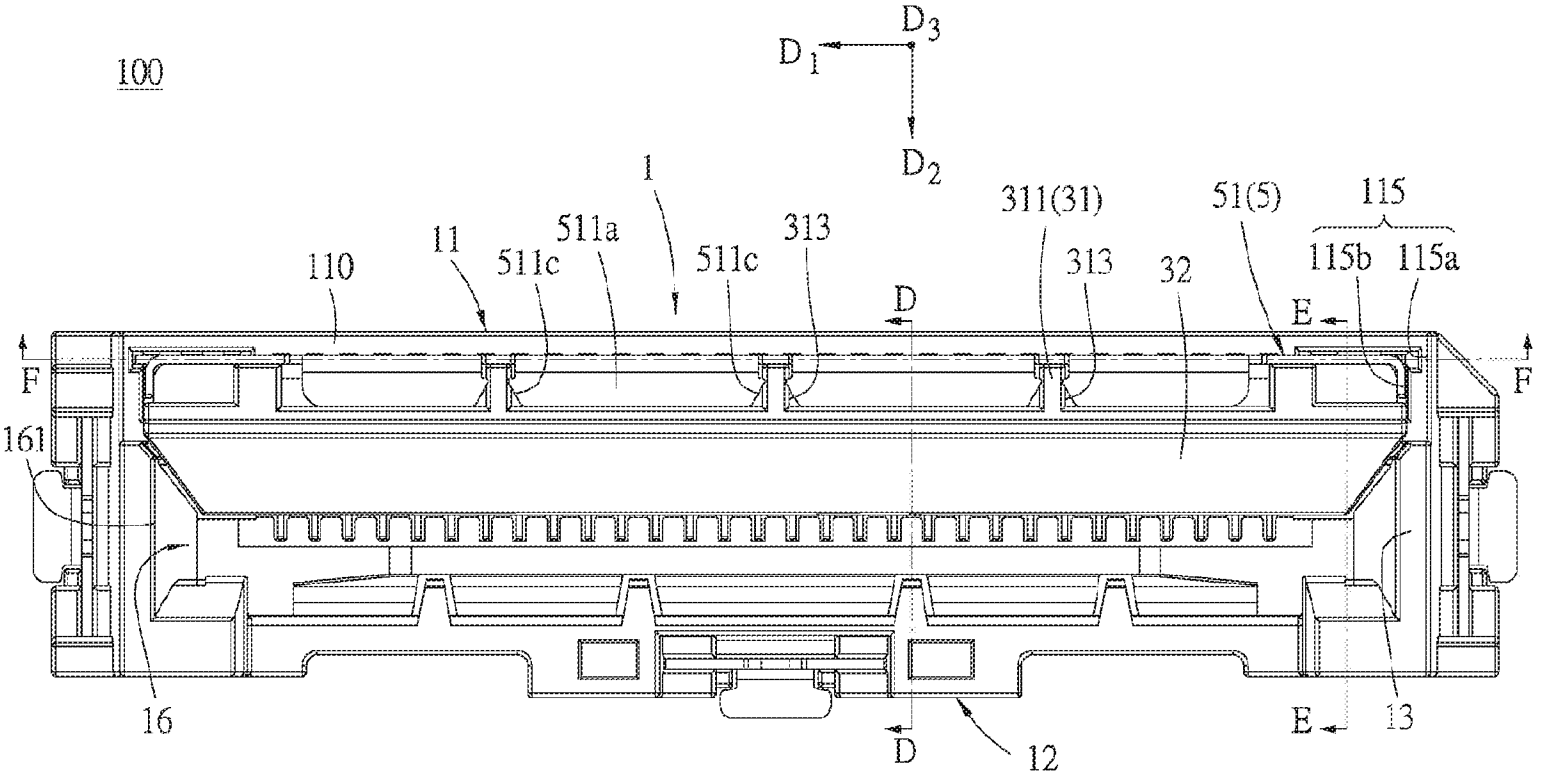
FIG. 26 is a top view of FIG. 19.
Figure 26:
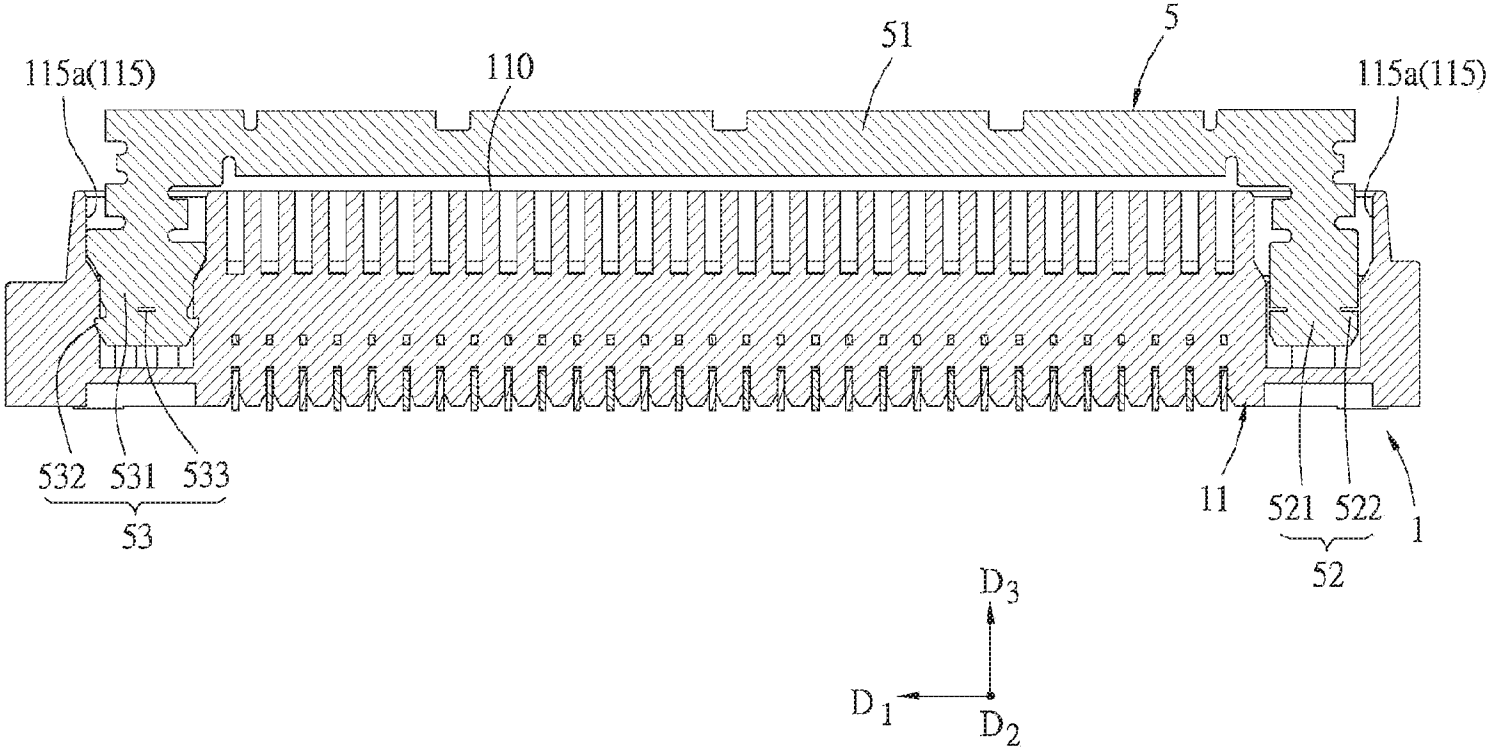

The mounting structure 52 correspondingly inserts into the insertion groove portion 115*a* of the mounting groove 115 which is formed with the partition wall 117, the mounting structure 52 has an inserting piece 521 which corresponds to the lower half part of the corresponding insertion groove portion 115*a* and two interference portions 522 which are formed at edges of the inserting piece 521 by tearing the inserting piece 521 and bend toward the partition wall 117 and protrude to interference with the wall body 117*a* of the partition wall 117 (see FIG. 22). The mounting structure 53 correspondingly inserts into the insertion groove portion 115*a* of the mounting groove 115 which is formed with the partition wall 118, the mounting structure 53 has an inserting piece 531 which correspondingly interference fits with the upper half part and the lower half part of the corresponding insertion groove portion 115*a*, two interference portions 532 which are respectively formed at a tip of the inserting piece 531 and extend in the length direction D1 to interference with an inner wall surface of the insertion groove portion 115*a*, and one interference portion 533 which is formed to the inserting piece 531 by tearing the inserting piece 531 and bends and protrudes toward the partition wall 118 to interference with the partition wall 118 (see FIG. 22). In this way, the mounting structures 52, 53 insert into the mounting grooves 115 by interference fit. And, by the premise that the bracket body 51 of the bracket 5 can maintain flexibility of the tongue portion 32 of the covering member 3, it enhances strength of the body 31 of the covering member 3. And by that the interference fit between the mounting structures 52, 53 of the bracket 5 and the mounting grooves 115, it can provide a holding force so as to make the covering member 3 more stably fixed to the terminal mounting wall 11. It may deduce that, in a varied embodiment, the two mounting structures 52, 53 also may be the same structure, and are not limited to different structures in the second embodiment. Here, the mounting groove 115 may be designed that it may be compatible with the configuration of the first embodiment and the configuration of the second embodiment at the same time, however also may be selected to one of the embodiments. In other words, the mounting groove 115 may have the insertion groove portion 115*a* and the mounting groove portion 115*b* as the above embodiments, however also may only have the insertion groove portion 115*a* or only have the mounting groove portion 115*b*.

In conclusion, in the card edge connector 100 of the present disclosure, by that the tongue portion 32 of the covering member 3 covers the opening 161 of the card edge insertion groove 16 and the contact portions 22 of the plurality of conductive terminals 2 positioned below, and by that the body 31 of the covering member 3 covers the aperture 113*a* of each terminal groove 113 positioned at the top surface 110, it prevents particles such as metal or dust and the like falling into the card edge insertion groove 16 or the terminal grooves 113 to contaminate the conductive terminals 2, in turn avoids phenomena such as poor contact or short circuit occurring, and promotes the electric contact performance of the plurality of conductive terminals 2. And even if after the electronic module 20 is inserted into the card edge insertion groove 16, the tongue portion 32 of the covering member 3 having flexibility still can cooperate with the electronic module 20 to flex to cover a gap between the electronic module 20 and the terminal mounting wall 11 of the insulating housing 1.

However, the above description is only for the embodiments of the present disclosure, and the implementing scope of the present disclosure is not limited thereto, and all the simple equivalent changes and modifications according to the scope of the claims and the specification of the present disclosure are still fallen within the scope of the present disclosure.

What is claimed is:

1. A card edge connector, comprising:

an elongated insulating housing extending in a length direction, having two side walls which extend in the length direction and are spaced apart from each other in a width direction, the two side walls defining a card edge insertion groove which has an opening, at least one of the two side walls being a terminal mounting wall; and a plurality of conductive terminals arranged as a row in the length direction and provided to the terminal mounting wall, each conductive terminal having a contact portion which extends into the card edge insertion groove, the card edge connector further comprising a covering member which is correspondingly mounted to the terminal mounting wall, the covering member having a body and a tongue portion which is connected to the body and has flexibility, the body being mounted to the terminal mounting wall, the tongue portion extending in the length direction and at least partially covering the opening of the card edge insertion groove in the width direction.

2. The card edge connector of claim 1, wherein the terminal mounting wall is formed with a plurality of terminal grooves which respectively receive the conductive terminals, each terminal groove has an aperture positioned on a top surface of the terminal mounting wall, the body of the covering member covers the apertures of the plurality of terminal grooves.

3. The card edge connector of claim 1, wherein the terminal mounting wall is formed with two mounting grooves at a top surface, each mounting groove has a mounting groove portion, the body of the covering member has an elongated portion which extends in the length direction and provided to the top surface of the terminal mounting wall and two mounting columns which respectively extend from the elongated portion and insert into the mounting groove portions of the mounting grooves.

4. The card edge connector of claim 3, wherein an inner wall surface of the mounting groove portion of each mounting groove is formed with an interference protruding block which interferences with the corresponding mounting column.

5. The card edge connector of claim 1, wherein the terminal mounting wall is formed with two mounting grooves at the top surface, each mounting groove has an insertion groove portion, the card edge connector further comprises a bracket provided to the covering member, the bracket comprises a bracket body which extends in the length direction and allows the body of the covering member to be provided and two mounting structures which extend respectively from two ends of the bracket body and insert into the insertion groove portions of the mounting grooves.

6. The card edge connector of claim 5, wherein each mounting groove further has a mounting groove portion communicated with the insertion groove portion, the body of the covering member has an elongated portion which extends in the length direction and is provided to the top surface of the terminal mounting wall and two mounting columns which extend respectively from the elongated portion and insert into the mounting groove portions of the mounting grooves.

7. The card edge connector of claim 6, wherein the bracket body of the bracket is formed with a first fixing structure which is provided to the elongated portion and two second fixing structures which are respectively provided to the mounting columns.

8. The card edge connector of claim 5, wherein each mounting structure has an inserting piece and an interference portion which is formed to the inserting piece and interferences with the insertion groove portion.

9. The card edge connector of claim 3, wherein the elongated insulating housing has two end walls at two ends in the length direction and wherein the terminal mounting wall further has two first end portions which are positioned at two ends in the length direction and respectively connect the two end walls and a terminal providing portion which is positioned between the two first end portions and is provided with the plurality of conductive terminals, the two mounting grooves are respectively formed at the two first end portions of the terminal mounting wall.

10. The card edge connector of claim 1, wherein one of the two side walls is the terminal mounting wall, the other of the two side walls is a limiting wall which is not provided with the conductive terminal, the limiting wall has a recess opening which is formed at the top surface and corresponds to the plurality of conductive terminals in position and a low wall portion which is positioned below the recess opening and lower than the terminal mounting wall in height.

11. A card edge connector, adapted to allow an electronic module to insert, the card edge connector comprising:

an elongated insulating housing extending in a length direction, having two side walls which extend in the length direction and are spaced apart from each other in a width direction, the two side walls defining a card edge insertion groove which has an opening, at least one of the two side walls being a terminal mounting wall; and a plurality of conductive terminals arranged as a row in the length direction and provided to the terminal mounting wall, each conductive terminal having a contact portion which extends into the card edge insertion groove, the card edge connector further comprising a covering member which is correspondingly mounted to the terminal mounting wall, the covering member having a body and a tongue portion which is connected to the body and has flexibility, the body being mounted to the terminal mounting wall, the tongue portion extending in the length direction and at least partially covering the opening of the card edge insertion groove in the width direction;

wherein when the electronic module is inserted into the card edge insertion groove, the tongue portion contacts the electronic module and flexes toward the card edge insertion groove and covers a gap between the electronic module and the terminal mounting wall.

12. The card edge connector of claim 11, wherein the terminal mounting wall is formed with a plurality of terminal grooves which respectively receive the conductive terminals, each terminal groove has an aperture positioned on a top surface of the terminal mounting wall, the body of the covering member covers the apertures of the plurality of terminal grooves.

13. The card edge connector of claim 11, wherein the terminal mounting wall is formed with two mounting grooves at a top surface, each mounting groove has a mounting groove portion, the body of the covering member has an elongated portion which extends in the length direction and provided to the top surface of the terminal mounting wall and two mounting columns which respectively extend from the elongated portion and insert into the mounting groove portions of the mounting grooves.

14. The card edge connector of claim 13, wherein an inner wall surface of the mounting groove portion of each mounting groove is formed with an interference protruding block which interferences with the corresponding mounting column.

15. The card edge connector of claim 11, wherein the terminal mounting wall is formed with two mounting grooves at a top surface, each mounting groove has an insertion groove portion, the card edge connector further comprises a bracket provided to the covering member, the bracket comprises a bracket body which extends in the length direction and allows the body of the covering member to be provided and two mounting structures which extend respectively from two ends of the bracket body and insert into the insertion groove portions of the mounting grooves.

16. The card edge connector of claim 15, wherein each mounting groove further has a mounting groove portion communicated with the insertion groove portion, the body of the covering member has an elongated portion which extends in the length direction and is provided to the top surface of the terminal mounting wall and two mounting columns which extend respectively from the elongated portion and insert into the mounting groove portions of the mounting grooves.

17. The card edge connector of claim 16, wherein the bracket body of the bracket is formed with a first fixing structure which is provided to the elongated portion and two second fixing structures which are respectively provided to the mounting columns.

18. The card edge connector of claim 15, wherein each mounting structure has an inserting piece and an interference portion which is formed to the inserting piece and interferences with the insertion groove portion.

19. The card edge connector of claim 13, wherein the elongated insulating housing has two end walls at two ends in the length direction and wherein the terminal mounting wall further has two first end portions which are positioned at two ends in the length direction and respectively connect the two end walls and a terminal providing portion which is positioned between the two first end portions and is provided with the plurality of conductive terminals, the two mounting grooves are respectively formed at the two first end portions of the terminal mounting wall.

20. The card edge connector of claim 11, wherein one of the two side walls is the terminal mounting wall, the other of the two side walls is a limiting wall which is not provided with the conductive terminal, the limiting wall has a recess opening which is formed at the top surface and corresponds to the plurality of conductive terminals in position and a low wall portion which is positioned below the recess opening and lower than the terminal mounting wall in height.

* * * * *